US009891543B2

(12) United States Patent
Kadokura et al.

(10) Patent No.: US 9,891,543 B2
(45) Date of Patent: Feb. 13, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yasuo Kadokura, Kanagawa (JP); Hiroyoshi Okuno, Kanagawa (JP); Satoshi Inoue, Kanagawa (JP); Yoshifumi Iida, Kanagawa (JP); Tomohito Nakajima, Kanagawa (JP); Yuka Zenitani, Kanagawa (JP); Yoshifumi Eri, Kanagawa (JP); Yasuhisa Morooka, Kanagawa (JP); Shunsuke Nozaki, Tokyo (JP); Takeshi Iwanaga, Kanagawa (JP); Sakae Takeuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/211,974

(22) Filed: Jul. 15, 2016

(65) Prior Publication Data

US 2017/0227863 A1 Aug. 10, 2017

(30) Foreign Application Priority Data

Feb. 10, 2016 (JP) ..... 2016-024123

(51) Int. Cl.

*G03G 9/097* (2006.01)
*G03G 9/08* (2006.01)
*G03G 15/08* (2006.01)

(52) U.S. Cl.

CPC ..... *G03G 9/0825* (2013.01); *G03G 9/0819* (2013.01); *G03G 9/0827* (2013.01); *G03G 15/08* (2013.01); *G03G 15/0865* (2013.01); *G03G 2215/0132* (2013.01)

(58) Field of Classification Search

CPC ..... G03G 9/09708; G03G 9/09716; G03G 9/09725; G03G 9/09733

See application file for complete search history.

(56) References Cited

U.S. PATENT DOCUMENTS

| | | | | |
|---|---|---|---|---|
| 6,057,073 | A * | 5/2000 | Hagiwara | G03G 9/09716 399/111 |
| 6,316,155 | B1 | 11/2001 | Kudo et al. | |
| 2001/0051270 | A1 | 12/2001 | Yamashita et al. | |
| 2003/0232185 | A1 | 12/2003 | Shimamura et al. | |
| 2007/0201917 | A1* | 8/2007 | Teshigawara | G03G 21/0017 399/350 |
| 2009/0067894 | A1 | 3/2009 | Yamada et al. | |
| 2010/0203441 | A1 | 8/2010 | Kataoka et al. | |
| 2011/0177444 | A1* | 7/2011 | Mattison, Jr. | G03G 9/0821 430/108.3 |
| 2012/0189851 | A1 | 7/2012 | Zenitani et al. | |
| 2014/0057107 | A1 | 2/2014 | Zenitani et al. | |
| 2016/0139521 | A1* | 5/2016 | Tsuda | G03G 9/0827 430/108.7 |

FOREIGN PATENT DOCUMENTS

| | | | | |
|---|---|---|---|---|
| EP | 1 845 419 | A2 | 10/2007 | |
| EP | 2 479 208 | * | 7/2012 | C08J 3/12 |
| JP | 2000-330328 | A | 11/2000 | |
| JP | 2009-098700 | A | 5/2009 | |
| JP | 4347201 | B2 | 10/2009 | |
| JP | 2009-292915 | A | 12/2009 | |
| JP | 2010-185999 | A | 8/2010 | |
| JP | 4758655 | B2 | 8/2011 | |
| JP | 4828032 | B2 | 11/2011 | |
| JP | 2014-162678 | A | 9/2014 | |
| JP | 2014-185069 | A | 10/2014 | |

OTHER PUBLICATIONS

Apr. 14, 2017 Office Action issued in U.S. Appl. No. 15/218,781.
U.S. Appl. No. 15/218,781, filed Jul. 25, 2016 in the name of Morooka et al.
U.S. Appl. No. 15/001,950, filed Jan. 20, 2016 in the name of Okuno et al.

* cited by examiner

*Primary Examiner* — Hoa V Le
(74) *Attorney, Agent, or Firm* — Oliff PLC

(57) ABSTRACT

An electrostatic charge image developing toner includes toner particles and an external additive that includes silica particles having a compression aggregation degree of 60% to 95% and a particle compression ratio of 0.20 to 0.40 and fatty acid metal salt particles.

15 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-024123 filed Feb. 10, 2016.

BACKGROUND

1. Technical Field

The present invention relates to an electrostatic charge image developing toner, an electrostatic charge image developer, and a toner cartridge.

2. Related Art

A method of visualizing image information through an electrostatic charge image by using an electrophotographic method has been used in various fields. In the electrophotographic method, image information is formed as the electrostatic charge image on a surface of an image holding member by a charging step and an exposing step, a toner image is developed on a surface of a photoreceptor by using a developer containing toner in a developing step, the obtained toner image is transferred to a recording medium such as a sheet in a transferring step, and the toner image is fixed onto the surface of the recording medium in a fixing step, thereby visualizing the toner image as an image.

SUMMARY

According to an aspect of the invention, there is provided an electrostatic charge image developing toner including:

toner particles; and an external additive that includes silica particles having a compression aggregation degree of 60% to 95% and a particle compression ratio of 0.20 to 0.40 and fatty acid metal salt particles.

BRIEF DESCRIPTION OF THE DRAWINGS

Exemplary embodiments of the present invention will be described in detail based on the following figures, wherein.

DETAILED DESCRIPTION

Figure 1:
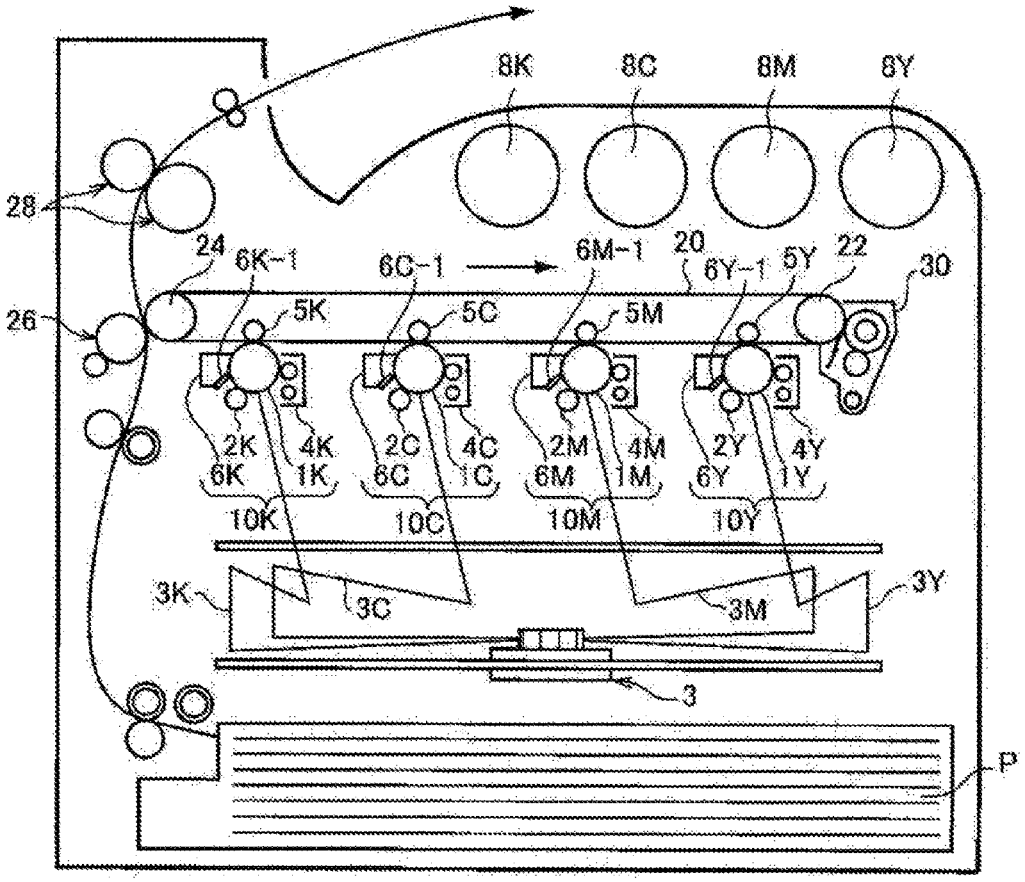
FIG. 1 is a configuration diagram schematically illustrating an example of an image forming apparatus of this exemplary embodiment.

Hereinafter, exemplary embodiments of the present invention will be described.

Electrostatic Charge Image Developing Toner

An electrostatic charge image developing toner (hereinafter, referred to as "toner") of this exemplary embodiment is a toner that has toner particles, external additives which include silica particles (hereinafter, referred to as "specific silica particles") having a compression aggregation degree of 60% to 95%, and a particle compression ratio of 0.20 to 0.40, and fatty acid metal salt particles.

Here, in the related art, when a structure in which the silica particles are externally added (in a state where the silica particles are attached to the toner particles) is changed in the toner obtained by externally adding silica particles to the toner particles, the fluidity of toner is deteriorated, and the charging maintainability may be deteriorated. The reason for the change of the externally added structure is that the silica particles are moved and unevenly distributed on the toner particles, and are isolated from toner particles. Particularly, in a case where toner particles in which the degree of circularity is high, for example, the average circularity is from 0.98 to 1.00, and the shape is approximated to a true sphere is used, it is likely that the silica particles are moved on the toner particles and are isolated from the toner particles, and thereby the externally added structure is likely to be changed.

In addition, in a case where the toner particles in which the degree of circularity is high, for example, the average circularity is from 0.98 to 1.00, and the shape is approximated to a true sphere is used, when the same images are repeatedly formed, slipping of the toner particles is likely to be caused from the cleaning blade. When the shape of the toner particle is approximated to a true sphere, the surface thereof may become smooth, and thus the toner particles are not easily scraped by a cleaning portion (a contact portion between the cleaning blade and the photoreceptor (an image holding member)). For this reason, in the case where the same images are repeatedly formed, and a large amount of the toner particles reach the same area of the cleaning portion, the slipping of the toner particles is likely to be caused.

On the other hand, the silica particles which are externally added to the toner particles may be isolated from the toner particles due to a mechanical load caused by stirring in a developing unit, and the scrapping in the cleaning portion. When reaching the cleaning portion, the isolated silica particles are dammed at a tip end (a downstream portion of the contact portion between the cleaning blade and the photoreceptor in the rotation direction) of the contact portion of the cleaning portion, and are aggregated due to the pressure of the cleaning blade, and thereby an aggregate (an external additive dam) is formed. The obtained external additive dam contributes to the improvement of cleaning ability.

In addition, in a case where the silica particles are used in combination with fatty acid metal salt particles, as the external additive, the fatty acid metal salt particles may be isolated from the toner particles. Similarly, when reaching the cleaning portion, the isolated fatty acid metal salt particles are also dammed at a tip end of the cleaning portion, and thus forma portion of the external additive dam. The fatty acid metal salt particles have excellent lubricity, and thus the abrasion of the cleaning blade is prevented.

However, the fatty acid metal salt particles are positively charged whereas toner particles are negatively charged, and thus in a developing step, a number of fatty acid metal salt particles are likely to attach to a non-imaged portion of the photoreceptor as compared with an imaged portion. Therefore, the balance of lubricity between the imaged portion and the non-imaged portion of the photoreceptor is lost, and thus the abrasion of the photoreceptor may be caused. Particularly, in a case where toner images having a low image density are continuously formed, it is not easy to secure the lubricity of the imaging portion, and thus uneven abrasion of the photoreceptor may be caused.

Further, when the slipping of the toner particles is caused, a large amount of the silica particles (the silica particles of the external additive dam) which are dammed by the cleaning portion also slip through the cleaning blade, and thus the photoreceptor may be damaged by the silica particles. Note that, it is considered that the damage of the photoreceptor is caused by sliding friction between the silica particles and the photoreceptor when the silica particles slip through the cleaning blade.

In this regard, in the toner according to the exemplary embodiment, the abrasion of the photoreceptor is prevented by externally adding specific silica particles and fatty acid metal salt particles to the toner particles. The reason for this is not clear, but is estimated as follows.

The specific silica particles in which the compression aggregation degree and the particle compression ratio satisfy the above-mentioned range are silica particles which have fluidity and high dispersibility with respect to the toner particles, and cohesion and high adhesion with respect to the toner particles.

The silica particles generally have excellent fluidity, but the bulk density thereof is low. For this reason, the silica particles have low adhesion and thus are not easily aggregated.

Meanwhile, a technique of performing a surface treatment on the surfaces of the silica particles by using a hydrophobizing agent in order to improve the fluidity of silica particles and the dispersibility with respect to the toner particles has been known. According to this technique, the fluidity of the silica particles, and the dispersibility with respect to the toner particles are improved, but the cohesion thereof are still deteriorated.

In addition, a technique of performing a surface treatment on the surface of the silica particles by using the hydrophobizing agent and silicone oil in combination has been known. According to this technique, both of the adhesion and the cohesion with respect to the toner particles are improved. However, the fluidity and the dispersibility with respect to the toner particles become easily deteriorated. That is, in the silica particles, the fluidity and the dispersibility with respect to the toner particles, and the cohesion and the adhesion with respect to the toner particles conflict with each other.

In contrast, in the case of the specific silica particles, four properties of the fluidity, the dispersibility with respect to the toner particles, the cohesion, and the adhesion with respect to the toner particles become excellent by setting the compression aggregation degree, and the particle compression ratio to be in the above-described range.

Next, the reason why the compression aggregation degree, and the particle compression ratio of the specific silica particles are set to be in the above-described range will be sequentially described.

First, the reason why the compression aggregation degree of the specific silica particles is set to be from 60% to 95% will be described.

The compression aggregation degree becomes an index which indicates the cohesion of the silica particles and the adhesion thereof with respect to the toner particles. This index is indicated based on the degree of difficulties to disperse a molded body of the silica particles which is obtained by compressing the silica particles when the molded body is dropped down.

Accordingly, as the compression aggregation degree is high, the silica particles tends to easily have a high bulk density and an enhanced cohesive force (force between molecules), and the adhesive force thereof with respect to the toner particles is also enhanced. Note that, a method of calculating the compression aggregation degree will be described in detail.

For this reason, the specific silica particles having the high compression aggregation degree which is controlled to be in a range of 60% to 95% have excellent adhesion and the cohesion with respect to the toner particles. Here, in order to secure the fluidity and the dispersibility with respect to the toner particles and realize excellent adhesion and cohesion with respect to the toner particles, the upper limit of the compression aggregation degree is set to be 95%.

Subsequently, the reason why the particle compression ratio of the specific silica particles is set to be in a range of 0.20 to 0.40 will be described.

The particle compression ratio becomes an index which indicates the fluidity of the silica particles. Specifically, the particle compression ratio is indicated based on the ratio of the difference between hardened apparent specific gravity and loose apparent specific gravity of the silica particles to the hardened apparent specific gravity ((hardened apparent specific gravity−loose apparent specific gravity)/hardened apparent specific gravity).

Accordingly, as the particle compression ratio becomes lower, the fluidity of the silica particles becomes higher. In addition, when the fluidity is high, the dispersibility with respect to the toner particles tends to be improved. Note that, a method of calculating the particle compression ratio will be specifically described below.

For this reason, the specific silica particles having the particle compression ratio which is controlled to be low, for example, in a range of 0.20 to 0.40 have excellent fluidity and the dispersibility with respect to the toner particles. Here, in order to realize excellent fluidity and the dispersibility with respect to the toner particles, and improve the adhesion and the cohesion with respect to the toner particles, the lower limit of the particle compression ratio is set to be 0.20. From the above, the specific silica particles have particular properties such as fluidity, dispersivity to the toner particles, a cohesive force, and an adhesive force to the toner particles. Therefore, the specific silica particles whose compression aggregation degree and the particle compression ratio satisfy the above range are the silica particles having high fluidity and dispersivity to the toner particles, and high cohesive properties and adhesion to the toner particles.

Next, the estimated effects when the specific silica particles and the fatty acid metal salt particles are externally added to the toner particles will be described.

First, the specific silica particles have the high fluidity and dispersibility with respect to the toner particles, and thus when being externally added to the toner particles, the specific silica particles are easily attached onto the surfaces of the toner particles in a uniform manner. In addition, once the specific silica particles are attached to the toner particles, the adhesion with respect to the toner particles becomes high, and thus the movement and isolation from the toner particles are less likely to occur on the toner particles due to a mechanical load by the stirring in a developing unit. In other words, the externally added structure is less likely to be changed. With this, the fluidity of the toner particles is improved, and the high fluidity is easily maintained. As a result, even in a case of using the toner particles which are approximated to the true sphere and cause the externally added structure to be easily changed, the deterioration of the charging maintainability is prevented.

On the other hand, the specific silica particles which are isolated from the toner particles due to a mechanical load caused by the scrapping in the cleaning portion, and then are supplied to the tip end of the cleaning portion have high cohesion, and thus are aggregated by the pressure of the cleaning blade, thereby forming a rigid external additive dam. Further, when the specific silica particles and the fatty acid metal salt particles are used in combination as the external additive, the rigid external additive dam which is formed of the specific silica particles is easily collapsed by impact. When the formed external additive dam is collapsed, the external additive is easily moved in the width direction of the cleaning portion of the photoreceptor. For this reason, it is likely that the fatty acid metal salt particles are more uniformly distributed in the width direction of the photoreceptor, and as a result, the abrasion of the photoreceptor may be prevented. Particularly, even in a case where the toner images having the low image density are continuously formed, uneven abrasion of the photoreceptor is prevented.

Furthermore, the cleaning ability is further improved by the rigid external additive dam, and thus the slipping of the toner particles is prevented even in a case where the same images are repeatedly formed and a number of the toner particles which are approximated to the true sphere reach the same cleaning portion area. As a result, the slipping of a number of silica particles (the silica particles of external additive dam) occurring when the toner particles slip the cleaning blade is also prevented, and thereby the photoreceptor is prevented from being damaged by the silica particles.

As described above, according to the toner of the exemplary embodiment, it is estimated that the abrasion of the photoreceptor is prevented. Further, it is estimated that the photoreceptor is prevented from being damaged when the same images are repeatedly formed.

In the toner according to the exemplary embodiment, the degree of particle dispersion of the specific silica particles is further preferably from 90% to 100%.

Here, the reason why the degree of particle dispersion of the specific silica particles is set in the range of 90% to 100% will be described.

The degree of particle dispersion becomes an index which indicates the dispersibility of the silica particles. This index is indicated based on the degree of easiness to disperse silica particles in a primary particle state into the toner particles. Specifically, the degree of particle dispersion is indicated based on the ratio of an actually measured coverage C with respect to an attaching target to a calculated coverage $C_0$ (actually measured coverage C/calculated coverage $C_0$) when the calculated coverage of the surface of the toner particle by the silica particles is set to be $C_0$, and the actually measured coverage is set to be C.

Accordingly, as the degree of particle dispersion is high, the silica particles are less likely to be aggregated, and thus the silica particles are easily dispersed into the toner particles while being in the primary particle state. Note that, a method of calculating the degree of particle dispersion will be described in detail.

The specific silica particle having the compression aggregation degree, and the particle compression ratio which are controlled to be in the above-described range, and the degree of particle dispersion which is controlled to be in a high range of 90% to 100% have further excellent dispersibility with respect to the toner particles. With this, the fluidity of the toner particles is improved, and the high fluidity is easily maintained. As a result, the specific silica particles are easily attached onto the surfaces of the toner particles in a uniform manner, and the charging maintainability is prevented from being deteriorated.

In the toner according to the exemplary embodiment, as the specific silica particles having the properties of the high fluidity and dispersibility with respect to the toner particles, and the high cohesion and adhesion with respect to the toner particles, as described above, the silica particles having a siloxane compound, which has a relatively large weight-average molecular weight, attached on the surface thereof are preferably used. Specifically, the silica particles having a siloxane compound, which has a viscosity of 1,000 cSt to 50,000 cSt, attached (preferably attached in a range of a surface attachment amount of 0.01% by weight to 5% by weight) on the surface thereof are preferably used. The specific silica particles are obtained by a method of performing the surface treatment on the surface of the silica particles such that the surface attachment amount is in a range of 0.01% by weight to 5% by weight by using, for example, the siloxane compound having a viscosity of 1,000 cSt to 50,000 cSt.

Here, the surface attachment amount is the proportion with respect to the silica particles (untreated silica particles) before performing the surface treatment on the surface of the silica particles. Hereinafter, the silica particles (that is, untreated silica particles) before being subjected to the surface treatment are simply referred to as "silica particles" as well.

The specific silica particles in which the surface treatment is performed on the surface of the silica particles such that the surface attachment amount is from 0.01% by weight to 5% by weight by using the siloxane compound having a viscosity of 1,000 cSt to 50,000 cSt have the fluidity and the dispersibility with respect to the toner particles, and the high cohesion and adhesion with respect to the toner particles, and thus the compression aggregation degree, and the particle compression ratio easily satisfy the above conditions. In addition, it is easy to prevent the deterioration of the charging maintainability and the abrasion of the photoreceptor. The reason for this is not clear, but is assumed as follows.

When a small amount of the siloxane compounds having the relatively high viscosity which is in the above-described range are attached on the surface of the silica particles in the above-described range, a function derived from the properties of the siloxane compound on the surface of the silica particles is realized. The mechanism thereof is not clear; however, when the silica particles are moved, the small amount of the siloxane compounds having the relatively high viscosity are attached in the above-described range, and thus release properties derived from the siloxane compound are easily realized, or the adhesion between the silica particles is deteriorated due to the reduction of an inter-particle force by steric hindrance of the siloxane compound. With this, the fluidity of the silica particles and the dispersibility thereof with respect to the toner particles are further improved.

On the other hand, when the silica particles are pressurized, long molecular chains of the siloxane compound on the surface of the silica particles being entangled, and close-packing properties of the silica particles are improved, thereby enhancing the aggregation of the silica particles. In addition, it is considered that the cohesive force of the silica particles due to the long molecular chains of the siloxane compound are entangled is released by causing the silica particles to be moved. In addition, due to the long molecular chain of the siloxane compound on the silica particle surface, the adhesive force with respect to the toner particles is also enhanced.

As described above, the specific silica particles in which a small amount of the siloxane compound having the viscosity in the above-described range is attached on the surface of the silica particles in the above-described range easily satisfy the compression aggregation degree, and the particle compression ratio, and the degree of particle dispersion also satisfy the above-described conditions.

Hereinafter, a configuration of the toner will be described in detail.

Toner Particles

The toner particles contain, for example, a binder resin, and if necessary, a colorant, a release agent, and other additives.

Binder Resin

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used singly or in combination of two or more kinds thereof.

A polyester resin is preferably used as the binder resin. Examples of the polyester resin include well-known polyester resin.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight-average molecular weight (Mw) of the polyester resin is preferably from 5,000 to 1,000,000, and is further preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and is further preferably from 2 to 60.

The weight-average molecular weight and the number-average molecular weight are measured by gel permeation chromatography (GPC). The molecular weight measurement by GPC is performed using GPC•HLC-8120 GPC, manufactured by Tosoh Corporation as a measuring device, Column TSK gel Super HM-M (15 cm), manufactured by Tosoh Corporation, and a THF solvent. The weight-average molecular weight and the number-average molecular weight are calculated using a molecular weight calibration curve plotted from a monodisperse polystyrene standard sample from the results of the foregoing measurement.

A known preparing method is used to prepare the polyester resin. Specific examples thereof include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, is further preferably from 50% by weight to 90% by weight, and is still further preferably from 60% by weight to 85% by weight, with respect to the entire toner particles.

Colorant

Examples of the colorant include pigment such as carbon black, chrome yellow, Hansa Yellow, Benzidine Yellow, Threne Yellow, Quinoline Yellow, Pigment Yellow, Permanent Orange GTR, pyrazolone orange, vulcan orange, Watchung red, permanent red, brilliant carmine 3B, brilliant carmine 6B, Du Pont Oil Red, pyrazolone Red, Lithol Red, rhodamine B lake, lake Red C, Pigment Red, Rose Bengal, aniline Blue, ultramarine Blue, Calco oil Blue, methylene Blue chloride, phthalocyanine Blue, Pigment Blue, phthalocyanine Green, and malachite Green oxalate, or various dyes such as an acridine dye, a xanthene dye, an azo dye, a benzoquinone dye, an azine dye, an anthraquinone dye, a thioindigo dye, a dioxazine dye, a thiazine dye, an azomethine dye, an indigo dye, a phthalocyanine dye, an aniline black dye, a polymethine dye, a triphenylmethane dye, a diphenylmethane dye, and a thiazole dye.

The colorant may be used singly or in combination of two or more types thereof.

As the colorant, the colorant which is subjected to the surface treatment may be used or the colorant may be used in combination with a dispersion agent as necessary. In addition, plural colorants may be used in combination.

The content of the colorant is preferably from 1% by weight to 30% by weight, and is further preferably from 3% by weight to 15% by weight with respect to the entire toner particles.

Release Agent

Examples of the release agent include a hydrocarbon wax; a natural wax such as a carnauba wax, a rice wax, and a candelilla wax; a synthetic or mineral•petroleum wax such as a montan wax; an ester wax such as fatty acid ester and montan acid ester; and the like. However, the release agent is not limited thereto.

The melting temperature of the release agent is preferably from 50° C. to 110°, and is further preferably from 60° C. to 100° C.

Note that, the melting temperature is obtained from "melting peak temperature" described in the method of obtaining a melting temperature in JIS K 7121-1987 "testing methods for transition temperatures of plastics", from a DSC curve obtained by differential scanning calorimetry (DSC).

The content of the release agent is preferably from 1% by weight to 20% by weight, and is further preferably from 5% by weight to 15% by weight, with respect to the entire toner particles.

Other Additives

Examples of other additives include known additives such as a magnetic material, a charge-controlling agent, and an inorganic powder. The toner particles contain these additives as internal additives.

Properties of Toner Particles

The toner particles may be toner particles having a single-layer structure, or toner particles having a so-called core•shell structure composed of a core (core particle) and a coating layer (shell layer) coated on the core.

Here, the toner particles having a core•shell structure is preferably composed of, for example, a core containing a binder resin, and if necessary, other additives such as a colorant and a release agent and a coating layer containing a binder resin.

The volume average particle diameter (D50v) of the toner particles is preferably from 2 μm to 10 μm, and is further preferably from 4 μm to 8 μm.

Various average particle diameters and various particle diameter distribution indices of the toner particles are measured using a COULTERMULTISIZER II (manufactured by Beckman Coulter, Inc.) and ISOTON-II (manufactured by Beckman Coulter, Inc.) as an electrolyte.

In the measurement, a measurement sample from 0.5 mg to 50 mg is added to 2 ml of a 5% aqueous solution of surfactant (preferably sodium alkylbenzene sulfonate) as a dispersing agent. The obtained material is added to the electrolyte from 100 ml to 150 ml.

The electrolyte in which the sample is suspended is subjected to a dispersion treatment using an ultrasonic disperser for 1 minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The average circularity of the toner particles is preferably from 0.95 to 1.00, and is preferably from 0.98 to 1.0. That is, the shape of the toner particle is preferably approximated to the true sphere.

The average circularity of the toners is preferably measured by FPIA-3000 manufactured by Sysmex Corporation. In this apparatus, a system in which the particles which are dispersed into water or the like are measured by using a flow type image analysis method is employed, the suctioned particle suspension is introduced to a flat sheath flow cell, and thereby a flat sample flow is formed by the sheath liquid. When the sample flow is irradiated with strobe light, the particles passing through the flow is captured as a still image through an objective lens by using a CCD camera. The captured particle image is subjected to two-dimensional image processing, and then a circle equivalent diameter and the degree of circularity are calculated from a projected area and a circumference length. As for the circle equivalent diameter of the respective captured particles, a diameter of a circle having the same area as the area of the two-dimensional image is calculated as the circle equivalent diameter. Regarding the degree of circularity, at least 4,000 images are analyzed, and then statistically processed so as to obtain the average circularity.

$$\text{Degree of circularity} = \text{circumference length of circle equivalent diameter}/\text{circumference length} = (2\times(A\pi)^{1/2})/PM$$

In the above expression, A represents the projected area, and PM represents the circumference length.

Note that, the measurement is performed by using a high resolution mode (HPF mode), and a dilution factor is set to be 1.0 time. In addition, in the analysis of data, the number particle diameter is set to be in an analysis range of 2.0 μm to 30.1 μm, and the degree of circularity is set to be in an analysis range of 0.40 to 1.00 so as to remove measured noise.

External Additive

The external additive includes the specific silica particles and the fatty acid metal salt particles. The external additive may include other external additives in addition to the specific silica particles and the fatty acid metal salt particles. That is, the toner particles may be obtained by externally adding the specific silica particles and the fatty acid metal salt particles thereto, and may be obtained by externally adding the specific silica particles, the fatty acid metal salt particles, and other external additives.

Specific Silica Particles

Degree of Compression and Aggregation

The compression aggregation degree of the specific silica particles is from 60% to 95%, is preferably from 65% to 95%, and is further preferably from 70% to 95% in order to secure the fluidity and the dispersibility with respect to the toner particles while obtaining excellent cohesion and adhesion with respect to the toner particles in the specific silica particles (particularly, in order to prevent the abrasion of the photoreceptor).

The compression aggregation degree is calculated by using the following method.

A disk-shaped mold having a diameter of 6 cm is filled with the specific silica particles of 6.0 g. Then, the mold is compressed at pressure of 5.0 t/cm$^2$ for 60 seconds by using a compacting machine (manufactured by Maekawa Testing Machine Mfg. Co., Ltd.) so as to obtain a molded body of specific silica particles (hereinafter, referred to as a "molded body before being dropped down") having a compressed disk shape. Thereafter, the weight of the molded body before being dropped down is measured.

Subsequently, the molded body before being dropped down is disposed on a sieving net having the size of 600 μm, and then is dropped down by using a vibration sieving machine (manufactured by Tsutusi Scientific Instruments Co., Ltd: production number: VIBRATING MVB-1) under the conditions of the amplitude (1 mm), and a vibration time (one minute). With this, the specific silica particles are dropped down from the molded body before being dropped down via the sieving net, and the molded body of the specific silica particles remains on the sieving net. Thereafter, the weight of a molded body of the remaining specific silica particle (hereinafter, referred to as a "molded body after being dropped down") is measured.

In addition, by using the following Expression (1), the compression aggregation degree is calculates based on the ratio of the weight of the molded body after being dropped down to the weight of the molded body before being dropped down.

Degree of compression and aggregation=(the weight of the molded body after being dropped down/the weight of the molded body before being dropped down)×100 Expression (1):

Particle Compression Ratio

The particle compression ratio of the specific silica particles is from 0.20 to 0.40, and is preferably from 0.24 to 0.38, and is further preferably from 0.28 to 0.36 in order to secure the fluidity and the dispersibility with respect to the toner particles while obtaining excellent cohesion and adhesion with respect to the toner particles in the specific silica particles (particularly, in order to prevent the abrasion of the photoreceptor).

The particle compression ratio aggregation is calculated by using the following method.

The loose apparent specific gravity and the hardened apparent specific gravity of the silica particles are measured by using a powder tester (manufactured by Hosokawa Micron Corporation, product number: PT-S type). Then, the particle compression ratio is calculated based on the ratio of the difference between hardened apparent specific gravity and loose apparent specific gravity of the silica particles to the hardened apparent specific gravity by using the following Expression (2).

particle compression ratio=(hardened apparent specific gravity−loose apparent specific gravity)/hardened apparent specific gravity Expression (2):

Note that, the "loose apparent specific gravity" means a measurement value derived by weighting the silica particles with which a vessel having a capacity of 100 cm$^3$ is filled, that is, a specific gravity of the specific silica particles in a state where the vessel is filled with the specific silica particles which are naturally dropped down. The "hardened apparent specific gravity" means the apparent specific gravity obtained in such a manner that impacts (tapping) are repeatedly imparted to the bottom of the vessel 180 times at a stroke distance of 18 mm and a tapping rate of 50 times/min such that the vessel is degassed and the specific silica particles are re-arranged, and thus the vessel is tightly filled with the specific silica particles as compared with the state of the loose apparent specific gravity.

Particle Dispersion Degree

The degree of particle dispersion of the specific silica particles is preferably from 90% to 100%, is further preferably from 95% to 100%, and is still further preferably 100% in order to obtain further excellent dispersibility with respect to the toner particles (particularly, in order to prevent the abrasion of the photoreceptor).

The degree of particle dispersion is the ratio of an actually measured coverage C with respect to an attaching target with respect to a calculated coverage $C_0$, and is calculated by the following Expression (3).

particle dispersion degree=actually measured coverage $C$/calculated coverage $C_0$ Expression (3):

Here, the calculated coverage $C_0$ of the surface of the toner particle by the specific silica particle may be calculated from the following Expression (3-1) when the volume average particle diameter of the toner particles is set as dt (m), the average equivalent circle diameter of the specific silica particles is set as da(m), the specific gravity of the toner particles is set as ρt, the specific gravity of the specific silica particles is set as ρa, the specific gravity of the toner particles is set as Wt(kg), and the additive amount of the specific silica particles is set as Wa(kg).

calculated coverage $C_0=\sqrt{3}/(2\pi)\times(\rho t/\rho a)\times(dt/da)\times(Wa/Wt)\times100(\%)$ Expression (3-1):

The actually measured coverage C of the surface of the toner particle by the specific silica particle may be calculated from the following Expression (3-2) by measuring the signal strength of a silicon atom which is derived from the specific silica particles with respect to the respective toner particles, specific silica particles, and the toner particles with which the specific silica particles are covered (attached), by using an X-ray photoelectron spectrometer (XPS) ("JPS-9000 MX": manufactured by JEOL Ltd.).

actually measured coverage $C=(z-x)/(y-x)\times100(\%)$Expression (3-2):

(In Expression (3-2), x represents the signal strength of the silicon atom derived from the specific silica particles of the toner particles. y represents the signal strength of the silicon atom derived from the specific silica particles of the specific silica particles. z represents the signal strength of the silicon atom derived from the toner particles with which the specific silica particles are covered (attached)).

Average Equivalent Circle Diameter

The average equivalent circle diameter of the specific silica particles is preferably from 40 nm to 200 nm, is further preferably from 50 nm to 180 nm, and is still further preferably from 60 nm to 160 nm in order to obtain excellent fluidity, dispersibility with respect to the toner particles, cohesion, and adhesion with respect to the toner particles in the specific silica particles (particularly, in order to prevent the abrasion of the photoreceptor).

The average equivalent circle diameter D50 of the specific silica particles is obtained as follows. The primary particles obtained by externally adding the specific silica particles to the toner particles are observed by using a scanning electron microscope (SEM) (S-4100: manufactured by Hitachi, Ltd.) so as to capture an image, and the captured image is analyzed by using an image analyzer (LUZEXIII: manufactured by NIRECO.), the area for each particle is measured by the image analysis of the primary particles, and the circle equivalent diameter is calculated from the value of measured area. At this time, 50% diameter (D50) in the cumulative frequency of volume basis of the obtained circle equivalent diameter is set as the average equivalent circle diameter D50 of the specific silica particles. Note that, the magnification of the electronic microscope is adjusted such that 10 to 50 particles of the specific silica particles are come out in a single view, and the circle equivalent diameter of the primary particles are obtained by combining the observation of the specific silica particles in plural views.

Average Circularity

The shape of the specific silica particle may be any one of a spherical shape and an anisotropic shape, and the average circularity of the specific silica particles is preferably from 0.85 to 0.98, is further preferably from 0.90 to 0.98, and is still further preferably from 0.93 to 0.98 in order to obtain excellent fluidity, dispersibility with respect to the toner particles, cohesion, and adhesion with respect to the toner particles in the specific silica particle (particularly, in order to prevent the abrasion of the photoreceptor).

The average circularity of the specific silica particles is calculated by using the following method.

First, the primary particles obtained by externally adding the specific silica particles to the toner particles are observed by using the scanning electron microscope, and based on the plane image analysis of the obtained primary particles, the degree of circularity of the specific silica particles is obtained as "100/SF2" which is calculated by the following expression.

$$\text{degree of circularity } (100/SF2) = 4\pi \times (A/I^2) \qquad \text{Expression:}$$

In Expression, I represents a circumference length of the primary particles on the image, and A represents a projected image area of the primary particles.

In addition, the average circularity of the specific silica particles is obtained as 50% circularity in the cumulative frequency of the circularity of 100 primary particles which is obtained based on the plane image analysis.

Here, a method of measuring the respective properties (the compression aggregation degree, the particle compression ratio, the degree of particle dispersion, and the average circularity) of the specific silica particles from the toner will be described.

First, the specific silica particles are separated from the toner in the following manner.

The external additive may be separated from the toner in such a manner that the toner is put and dispersed in methanol, and the mixture is stirred and treated in an ultrasonic bath. The particle diameter and the specific gravity of the external additive affect the separation of the external additives, for example, the fatty acid metal salt particles having a large particle diameter are easily separated, and thus only the fatty acid metal salt particles may be separated from the surface of the toner by setting the level of the ultrasonic treatment to be low. Then, the specific silica particles may be detached from the surface of the toner by changing the level of the ultrasonic treatment to be high. Only the methanol in which the external additives are dispersed by allowing the toner to be settled by centrifugation is collected, and then, the methanol is volatilized, thereby extracting the specific silica particles and the fatty acid metal salt particles. The above level of the ultrasonic treatment is required to be adjusted by the specific silica particles and the fatty acid metal salt particles.

In addition, the above-described properties are measured by using the separated specific silica particles.

Hereinafter, a configuration of the specific silica particle will be described in detail.

Specific Silica Particle

The specific silica particle is a particle containing silica (that is, $SiO_2$) as a major component, and may be crystalline or non-crystalline. The specific silica particle may be a particle prepared by using a silicon compound such as water glass and alkoxysilane as a raw material, or may be a particle obtained by grinding quartz. Specifically, examples of the specific silica particle include a silica particle (hereinafter, referred to as "sol-gel silica particles") prepared by using a sol-gel method, an aqueous colloidal silica particle, an alcoholic silica particle, a fumed silica particle obtained by using a gas-phase method, and a fused silica particle. Among them, the sol-gel silica particle is preferably used.

Surface Treatment

The specific silica particles are preferably subjected to the surface treatment by using the siloxane compound such that the compression aggregation degree, the particle compression ratio, and the degree of particle dispersion are set to be in the specific range as described above.

As a method of the surface treatment by using supercritical carbon dioxide, a method of performing the surface treatment on the surface of the silica particles in supercritical carbon dioxide is preferably used. Note that the method of the surface treatment will be described below.

Siloxane Compound

The siloxane compound is not particularly limited as long as it has a siloxane skeleton in a molecular structure.

Examples of the siloxane compound include a silicone oil and a silicone resin. Among them, the silicone oil is preferably used from the aspect that the surface of the silica particles is subjected to the surface treatment in a nearly uniform state.

Examples of the silicone oil include a dimethyl silicone oil, a methyl hydrogen silicone oil, a methyl phenyl silicone oil, an amino-modified silicone oil, an epoxy-modified silicone oil, a carboxyl-modified silicone oil, a carbinol-modified silicone oil, a methacryl-modified silicone oil, a mercapto-modified silicone oil, a phenol-modified silicone oil, a polyether-modified silicone oil, a methyl styryl modified silicone oil, an alkyl-modified silicone oil, a higher fatty acid ester modified silicone oil, a higher fatty acid amides modified silicone oil, and a fluorine-modified silicone oil.

Among them, the dimethyl silicone oil, the methyl hydrogen silicone oil, and the amino-modified silicone oil are preferably used.

The above-described siloxane compound may be used singly or in combination of two or more types thereof.

Viscosity

The viscosity (kinetic viscosity) of the siloxane compound is preferably from 1,000 cSt to 50,000 cSt, is further preferably from 2,000 cSt to 30,000 cSt, and is still further preferably from 3,000 cSt to 10,000 cSt in order to obtain excellent fluidity, dispersibility with respect to the toner particles, cohesion, and adhesion with respect to the toner particles in the specific silica particles (particularly, in order to prevent the abrasion of the photoreceptor).

The viscosity of the siloxane compound is obtained by the following procedure. Toluene is added to the specific silica particles and dispersed for 30 minutes by an ultrasonic disperser. Thereafter, a supernatant is collected. At this time, the siloxane compound having a concentration of 1 g/100 ml is assumed to be a toluene solution. The viscosity ($\eta_{sp}$) (25° C.) at this time is obtained by the following Expression (A).

$$\eta_{sp}=(\eta/\eta_0)-1 \quad \text{Expression (A):}$$

($\eta_0$: the viscosity of toluene, $\eta$: the viscosity of solution)

Next, the intrinsic viscosity ($\eta$) is obtained by substituting the specific viscosity ($\eta_{sp}$) for Huggins' relational expression indicated by the following Expression (B).

$$\eta_{sp}=(\eta)+K'(\eta)^2 \quad \text{Expression (B):}$$

(K': Huggins' constant K'=0.3 (at the time of applying ($\eta$)=1 to 3)

Then, a molecular weight M is obtained by substituting the intrinsic viscosity ($\eta$) for A. Kolorlov's expression indicated by the following Expression (C).

$$(\eta)=0.215\times10^{-4}M^{0.65} \quad \text{Expression (C):}$$

The siloxane viscosity ($\eta$) is obtained by substituting the molecular weight M for A. J. Barry's expression indicated by the following Expression (D).

$$\log \eta=1.00+0.0123M^{0.5} \quad \text{Expression (D):}$$

Surface Attachment Amount

The surface attachment amount of the siloxane compound with respect to the surface of the specific silica particle is preferably from 0.01% by weight to 5% by weight, is further preferably from 0.05% by weight to 3% by weight, and is still further preferably from 0.10% by weight to 2% by weight with respect to the silica particles (silica particles before being subjected to the surface treatment), in order to obtain excellent fluidity, dispersibility with respect to the toner particles, cohesion, and adhesion with respect to the toner particles in the specific silica particles (particularly, in order to prevent the abrasion of the photoreceptor).

The surface attachment amount is measured by using the following method.

The specific silica particles of 100 mg are dispersed into chloroform of 1 mL, as an internal standard solution DMF (N,N-dimethyl formamide) of 1 μL is added thereto, and then the mixture is subjected to the ultrasonic treatment for 30 minutes by using an ultrasonic washing machine, and thereby the siloxane compound is extracted from a chloroform solvent. Thereafter, a hydrogen nucleus spectrum measurement is performed by using a nuclear magnetic resonance apparatus (JNM-AL 400 type: manufactured by JEOL Ltd.) so as to obtain the amount of the siloxane compounds based on the ratio of the siloxane compound DMF derived peak area to the DMF derived peak area. Then, the surface attachment amount is obtained from the obtained amount of the siloxane compound.

Here, the specific silica particles are subjected to the surface treatment by using the siloxane compound having a viscosity of 1,000 cSt to 50,000 cSt, and the surface attachment amount of the siloxane compound with respect to the surface of the silica particles is preferably from 0.01% by weight to 5% by weight.

When the above-described conditions are satisfied, it is easy to obtain the specific silica particle in which the fluidity and the dispersibility with respect to the toner particles become excellent, and the cohesion and the adhesion with respect to the toner particles are improved.

Method of Preparing Specific Silica Particles

The specific silica particles are obtained by performing the surface treatment on the surface of the silica particles by using the siloxane compound which has a viscosity of 1,000 cSt to 50,000 cSt such that the surface attachment amount is from 0.01% by weight to 5% by weight with respect to the silica particles.

According to the method of preparing the specific silica particles, it is possible to obtain the silica particles in which the fluidity and the dispersibility with respect to the toner particles become excellent, and the cohesion and the adhesion with respect to the toner particles are improved.

Examples of the method of surface treatment include a method of performing the surface treatment on the surface of the silica particles by using a siloxane compound in the supercritical carbon dioxide; and a method of performing the surface treatment on the surface of the silica particles by using a siloxane compound in atmosphere.

Specifically, examples of the method of surface treatment include a method of using the supercritical carbon dioxide, for example, a method of attaching the siloxane compound on the surface of the silica particles by dissolving the siloxane compound in the supercritical carbon dioxide; a method of attaching the siloxane compound on the surface of the silica particles by imparting (for example, spraying and applying) a solution which contains a siloxane compound and a solvent for dissolving the siloxane compound to the surface of the silica particles, in the atmosphere; and a method of adding and holding a solution which contains a siloxane compound and a solvent for dissolving the siloxane compound to a silica particle dispersion, and then drying a mixed solution of the silica particle dispersion and the above solution.

Among them, as the method of the surface treatment, the method of using the supercritical carbon dioxide, for example, the method of attaching the siloxane compound on the surface of the silica particles by dissolving the siloxane compound in the supercritical carbon dioxide is preferably used.

When the surface treatment is performed in the supercritical carbon dioxide, the siloxane compound is dissolved in the supercritical carbon dioxide. Since the supercritical carbon dioxide has a property of low interfacial tension, it is considered that the siloxane compound which is dissolved in the supercritical carbon dioxide is deeply diffused in a hole portion of the surface of the silica particles along with the supercritical carbon dioxide, and thus easily reach the hole portion. It is also considered that not only the surface of the silica particles but also a deep part of the hole portion are subjected to the surface treatment by using the siloxane compound.

For this reason, it is considered that the silica particles which are subjected to the surface treatment by using the siloxane compound in the supercritical carbon dioxide become the silica particles of which the surface is treated to be in a nearly uniform state (for example, the surface treatment layer is formed into a thin film shape) by using the siloxane compound.

In addition, in the method of preparing the specific silica particles, the surface treatment in which the hydrophobicity is imparted to the surface of the silica particles by using a hydrophobizing agent together with the siloxane compound in the supercritical carbon dioxide may be performed.

In this case, it is considered that the hydrophobizing agent is dissolved together with the siloxane compound in the supercritical carbon dioxide, and the siloxane compound and the hydrophobizing agent which are dissolved in the supercritical carbon dioxide deeply diffused in a hole portion of the surface of the silica particles along with the supercritical carbon dioxide, and thus easily reach the hole portion. It is also considered that not only the surface of the silica particles but also a deep part of the hole portion are subjected to the surface treatment by using the siloxane compound and the hydrophobizing agent.

As a result, the silica particles which are subjected to the surface treatment by using the siloxane compound and the hydrophobizing agent in the supercritical carbon dioxide are treated to be in a nearly uniform state by using the siloxane compound and the hydrophobizing agent, and the high hydrophobicity is easily imparted thereto.

In addition, in the method of preparing the specific silica particles, the supercritical carbon dioxide may be used in other steps of preparing the silica particles (for example, a solvent removing step).

Examples of the method of preparing the specific silica particles which uses the supercritical carbon dioxide in other preparing steps include a step of preparing a silica particle dispersion containing silica particles and a solvent which includes alcohol and water (hereinafter, referred to as a "dispersion preparing step") by using a sol-gel method, a step of removing the solvent from the silica particle dispersion by circulating the supercritical carbon dioxide (hereinafter, referred to as a "solvent removing step"), and a step of performing the surface treatment on the surface of the silica particles after removing the solvent by using the siloxane compound in the supercritical carbon dioxide (hereinafter, referred to as a "surface treatment step").

When the solvent is removed from the silica particle dispersion by using the supercritical carbon dioxide, the occurrence of coarse powders is likely to be prevented.

The reason for this is not clear, but is assumed as follows. 1) in a case where the solvent of the silica particle dispersion is removed, the supercritical carbon dioxide has the property of "low interfacial tension", and thus the solvent may be removed without aggregation of particles by liquid crosslinking force at the time of removing the solvent, 2) due to the properties of the supercritical carbon dioxide "the carbon dioxide under the temperature•pressure equal to or higher than the critical point has both of the diffusivity of gas and the solubility of liquid", the solvent is efficiently brought into contact with the supercritical carbon dioxide at a relatively low temperature (for example, equal to or lower than 250° C.), and dissolved therein. With this, the solvent in the silica particle dispersion may be removed by removing the supercritical carbon dioxide in which the solvent is dissolved without causing coarse powders such as a secondary aggregate by condensation of silanol groups.

Here, the solvent removing step and the surface treatment step may be separately performed, but are preferably performed in a continuous manner (that is, each step is performed in a state of not being opened to the atmospheric pressure). When the respective steps are continuously performed, after the solvent removing step, the silica particles are less likely to adsorb moisture, and thus the surface treatment step may be performed in a state where the excessive adsorption of moisture to the silica particles is prevented. With this, it is no longer necessary that a large amount of siloxane compounds are used or the excessive heating is performed such that the solvent removing step and the surface treatment step are performed at a high temperature. As a result, the occurrence of coarse powders is likely to be more efficiently prevented.

Hereinafter, the respective steps of the method of preparing the specific silica particles will be described in detail.

Note that, the method of preparing the specific silica particles is not limited to the following description; for example, 1) a method of using the supercritical carbon dioxide only in the surface treatment step, or 2) a method of separately performing the respective steps may be employed.

Hereinafter, the respective steps will be described in detail.

Dispersion Preparing Step

In the dispersion preparing step, for example, a silica particle dispersion containing the silica particles and a solvent which includes alcohol and water is prepared.

Specifically, in the dispersion preparing step, for example, the silica particle dispersion is prepared by using a wetting method (for example, a sol-gel method). Specifically, the silica particle dispersion may be prepared by reacting (hydrolysis reaction, a condensation reaction) tetraalkoxysilane with the solvent of alcohol and water under the existence of an alkali catalyst so as to prepare the silica particles by using, particularly, the sol-gel method as the wet method.

Note that, a preferable range of the average equivalent circle diameter of the silica particles, and a preferable range of the average circularity are the same as described above.

In the dispersion preparing step, for example, in a case where the silica particles are obtained by using the wetting method, the silica particles are obtained in a dispersion state (silica particle dispersion) which is a state where the silica particles are dispersed in the solvent.

Here, when the process proceeds to the solvent removing step, in the silica particle dispersion to be prepared, the weight ratio of water with respect to the alcohol may be from 0.05 to 1.0, is preferably from 0.07 to 0.5, and is further preferably from 0.1 to 0.3.

In the silica particle dispersion, when the weight ratio of water with respect to the alcohol is in the above-described range, after the surface treatment, the coarse powders of the silica particles are less likely to occur, and the silica particles having excellent electrical resistance are easily obtained.

When the weight ratio of water with respect to the alcohol is less than 0.05, the condensation of the silanol groups of the surface of the silica particles at the time of removing the solvent is decreased in the solvent removing step, and thus the amount of the adsorbed moisture is increased on the surface of the silica particles after removing the solvent, and the electrical resistance of the silica particles after being subjected to the surface treatment may be excessively decreased. In addition, when the weight ratio of water is greater than 1.0, in the solvent removing step, a large amount of water remains in the silica particle dispersion in the vicinity of the end of removing the solvent, and the silica particles are easily aggregated due to the liquid crosslinking force, and thus may remain as the coarse powders after being subjected to the surface treatment.

Further, when the process proceeds to the solvent removing step, in the silica particle dispersion to be prepared, the weight ratio of water with respect to the silica particles may be from 0.02 to 3, is preferably from 0.05 to 1, and is further preferably from 0.1 to 0.5.

In the silica particle dispersion, the weight ratio of water with respect to the silica particles is in the above-described range, the coarse powders of the silica particles are less likely to occur, and the silica particles having excellent electrical resistance are easily obtained.

When the weight ratio of water with respect to the silica particles is less than 0.02, the condensation of the silanol groups of the surface of the silica particles at the time of removing the solvent is extremely decreased in the solvent removing step, and thus the amount of the adsorbed moisture is increased on the surface of the silica particles after removing the solvent, and the electrical resistance of the silica particles may be excessively decreased.

In addition, when the weight ratio of water is greater than 3, in the solvent removing step, a large amount of water remains in the silica particle dispersion in the vicinity of the end of removing the solvent, and the silica particles are easily aggregated due to the liquid crosslinking force.

In addition, when the process proceeds to the solvent removing step, in the silica particle dispersion to be prepared, the weight ratio of the silica particles with respect to the silica particle dispersion may be from 0.05 to 0.7, is preferably from 0.2 to 0.65, and is further preferably from 0.3 to 0.6.

When the weight ratio of the silica particles with respect to the silica particle dispersion is less than 0.05, the amount of the supercritical carbon dioxide to be used in the solvent removing step is increased, and thus the productivity is deteriorated. In addition, when the weight ratio of the silica particles with respect to the silica particle dispersion is greater than 0.7, the silica particles becomes closer to each other in the silica particle dispersion, and thus it is likely that the silica particles are aggregated with each other and the coarse powders occurs due to gelation.

Solvent Removing Step

The solvent removing step is a step of removing the solvent of the silica particle dispersion, for example, by circulating the supercritical carbon dioxide.

That is, in the solvent removing step, the supercritical carbon dioxide is circulated to be brought into contact with the silica particle dispersion, and thereby the solvent is removed.

Specifically, in the solvent removing step, for example, the silica particle dispersion is put in a sealed reactor. Thereafter, the liquefied carbon dioxide is added in the sealed reactor and heated, and the pressure in the reactor is increased by using a high-pressure pump so as to set the carbon dioxide in a supercritical state. In addition, the supercritical carbon dioxide is introduced in and discharged from the sealed reactor so as to be circulated in the sealed reactor, that is, in the silica particle dispersion.

With this, the supercritical carbon dioxide is discharged to the outside (the outside in the sealed reactor) of the silica particle dispersion while dissolving the solvent (alcohol and water), and thereby the solvent is removed.

Here, the supercritical carbon dioxide is the carbon dioxide under the temperature•pressure equal to or higher than the critical point, and has both of the diffusivity of gas and the solubility of liquid.

The temperature condition of removing the solvent, that is, the temperature of the supercritical carbon dioxide may be, for example, from 31° C. to 350° C., is preferably from 60° C. to 300° C., and is further preferably from 80° C. to 250° C.

When the temperature is less than the above described range, the solvent is not easily dissolved in the supercritical carbon dioxide, and thus the solvent is not easily removed. In addition, the coarse powders are likely to occur due to the liquid crosslinking force of the solvent and the supercritical carbon dioxide. On the other hand, when the temperature is greater than the above-described range, the coarse powders such as the secondary aggregates are likely to occur due to the condensation of the silanol groups on the surface of the silica particles.

The pressure condition of removing the solvent, that is, the pressure of the supercritical carbon dioxide may be, for example, from 7.38 MPa to 40 MPa, is preferably from 10 MPa to 35 MPa, and is further preferably from 15 MPa to 25 MPa.

When the pressure is less than the above-described range, there is a tendency that the solvent is not easily dissolved into the supercritical carbon dioxide, on the other hand, when the pressure is greater than the above-described range, there is a tendency that the cost for the equipment is increased.

Further, the introducing and discharging amount of the supercritical carbon dioxide with respect to the sealed reactor may be, for example, from 15.4 L/min/$m^3$ to 1,540 L/min/$m^3$, and is preferably from 77 L/min/$m^3$ to 770 L/min/$m^3$.

When the introducing and discharging amount of the supercritical carbon dioxide is less than 15.4 L/min/$m^3$, it takes time to remove the solvent, and thus the productivity is deteriorated.

On the other hand, when the introducing and discharging amount of the supercritical carbon dioxide is greater than 1,540 L/min/$m^3$, the contact time of the silica particle dispersion is reduced by short path of the supercritical carbon dioxide, and thereby it is not easy to efficiently remove the solvent.

Surface Treatment Step

The surface treatment step is performed continuously with the solvent removing step. For example, the surface treatment step is a step of performing the surface treatment on the surface of the silica particles by using a siloxane compound in the supercritical carbon dioxide.

In other words, in the surface treatment step, for example, the surface treatment is performed on the surface of the silica particles by using the siloxane compound in the supercritical carbon dioxide before the process proceeds from the solvent removing step in a state of not being opened to the atmosphere.

Specifically, in the surface treatment step, for example, the temperature and pressure of the inside of the sealed reactor are adjusted after stopping the introducing and discharging of the supercritical carbon dioxide into the sealed reactor in the solvent removing step, and a certain amount of the siloxane compounds with respect to the silica particles are put into the sealed reactor under the existence of the supercritical carbon dioxide. In addition, in the state of maintaining the above state, that is, in the supercritical carbon dioxide, the siloxane compound is reacted so as to perform the surface treatment of the silica particle.

Here, in the surface treatment step, the reaction of the siloxane compound may be performed in the supercritical carbon dioxide (that is, under the atmosphere of the supercritical carbon dioxide), and the surface treatment may be performed while causing the supercritical carbon dioxide to be circulated (that is, the supercritical carbon dioxide is introduced into and discharged from the sealed reactor), or the surface treatment may be performed without causing the supercritical carbon dioxide to be circulated.

In the surface treatment step, the amount of the silica particles (that is, a prepared amount) with respect to the capacity of the reactor may be, for example, from 30 g/L to 600 g/L, is preferably from 50 g/L to 500 g/L, and is further preferably from 80 g/L to 400 g/L.

When this amount is less than the above-described range, the concentration with respect to the supercritical carbon dioxide of the siloxane compound becomes lower, and the contact probability with the silica surface is decreased, and thereby the reaction is not easily caused. On the other hand, when the amount of the silica particles is greater than the above-described range, since the concentration of the siloxane compound with respect to the supercritical carbon dioxide becomes higher, the siloxane compound is not completely dissolved in the supercritical carbon dioxide, which causes dispersion defect, and thus the coarse aggregates are likely to occur.

The density of the supercritical carbon dioxide may be, for example, from 0.10 g/ml to 0.80 g/ml, is preferably from 0.10 g/ml to 0.60 g/ml, and is further preferably from 0.2 g/ml to 0.50 g/ml.

When the density is lower than the above-described range, the solubility of the siloxane compound with respect to the supercritical carbon dioxide is deteriorated, and the aggregates are likely to be formed. On the other hand, when the density is greater than the above-described range, the diffusivity with respect to the silica pores is deteriorated, and thus the surface treatment may be not sufficiently performed. Particularly, with respect to the sol-gel silica particles containing a number of the silanol groups, the surface treatment may be performed in the above-described density range.

Note that, the density of the supercritical carbon dioxide is adjusted by, for example, the temperature and the pressure.

Specific examples of the siloxane compound are as described above. In addition, a preferable viscosity range of the siloxane compound is also described above.

Among the siloxane compounds, when the silicone oil is used, the silicone oil is easily attached to the surface of the silica particles in a nearly uniform state, and thus the fluidity, the dispersibility, and the handling property of the silica particles are easily improved.

From the aspect that the surface attachment amount with respect to the silica particles is easily adjusted from 0.01% by weight to 5% by weight, the use amount of the siloxane compounds may be, for example, from 0.05% by weight to 3% by weight, is preferably from 0.1% by weight to 2% by weight, and is further preferably from 0.15% by weight to 1.5% by weight, with respect to the silica particle.

Note that, the siloxane compound may be used singly, or may be used as a mixed solution with a solvent in which the siloxane compound is easily dissolved. Examples of the solvent include toluene, methyl ethyl ketone, and methyl isobutyl ketone.

In the surface treatment step, the surface treatment of the silica particles is performed by the mixture containing the siloxane compound and the hydrophobizing agent.

Examples of the hydrophobizing agent include a silane hydrophobizing agent. Examples of the silane hydrophobizing agent include a well-known silicon compound having an alkyl group (for example, a methyl group, an ethyl group, a propyl group, and a butyl group), and specifically include a silazane compound (for example, a silane compound such as methyltrimethoxysilane, dimethyldimethoxysilane, trimethylchlorosilane, and trimethylmethoxysilane, hexamethyldisilazane, and tetramethyldisilazane). The hydrophobizing agent may be used alone or plural types thereof may be used in combination.

Among the silane hydrophobizing agents, a silicon compound having a trimethyl group such as trimethylmethoxysilane and hexamethyldisilazane (HMDS), is preferably used, and the hexamethyldisilazane (HMDS) is particularly preferably used.

The use amount of the silane hydrophobizing agent is not particularly limited, for example, the amount may be from 1% by weight to 100% by weight, is preferably from 3% by weight to 80% by weight, and is further preferably from 5% by weight to 50% by weight, with respect to silica particles.

Note that, the silane hydrophobizing agent may be used singly, or may be used as a mixed solution with the solvent in which the silane hydrophobizing agent is easily dissolved. Examples of the solvent include toluene, methyl ethyl ketone, and methyl isobutyl ketone.

The temperature condition for the surface treatment, that is, the temperature of the supercritical carbon dioxide may be, for example, from 80° C. to 300° C., is preferably from 100° C. to 250° C., and is further preferably from 120° C. to 200° C.

When the temperature is lower than the above-described range, the performance of the surface treatment by using the siloxane compound may be deteriorated. On the other hand, when the temperature is higher than the above-described range, the reaction of the condensation is caused between the silanol groups of the silica particles, and thus a particle aggregation may occur. Particularly, with respect to the sol-gel silica particle containing a number of the silanol groups, the surface treatment may be performed in the above-described temperature range.

On the other hand, the pressure condition for the surface treatment, that is, the pressure of the supercritical carbon dioxide is not limited as long as it satisfies the above-described density. For example, the pressure of the supercritical carbon dioxide may be from 8 MPa to 30 MPa, is preferably from 10 MPa to 25 MPa, and is further preferably from 15 MPa to 20 MPa.

The specific silica particles are obtained through the foregoing steps.

Fatty Acid Metal Salt Particles

The fatty acid metal salt particles used in the exemplary embodiment are not particularly limited. As the fatty acid metal salt particles, well-known materials in the related art may be used, and examples thereof include aluminum stearate, calcium stearate, potassium stearate, magnesium stearate, barium stearate, lithium stearate, zinc stearate, copper stearate, lead stearate, nickel stearate, strontium stearate, cobalt stearate, cadmium stearate, zinc oleate, manganese oleate, iron oleate, cobalt oleate, copper oleate, magnesium oleate, lead oleate, zinc palmitate, cobalt palmitate, copper palmitate, magnesium palmitate, aluminum palmitate, calcium palmitate, zinc linoleate, cobalt linoleate, calcium linoleate, zinc ricinoleate, cadmium ricinoleate, and lead caproate.

In the exemplary embodiment, as the fatty acid metal salt particles, the zinc stearate is preferably used.

The average particle diameter of the fatty acid metal salt particles is preferably from 0.5 μm to 15 μm, and is further preferably from 2 μm to 10 μm.

The average particle diameter of the fatty acid metal salt particles is measured by performing the observation of 100 views (50,000 times) by using a scanning electron microscope (S-4700 type, manufactured by Hitachi, Ltd.), measuring 1,000 particle diameters (an average value of a long diameter and a short diameter) by approximating the particles corresponding to an image area of the fatty acid metal salt particles as a circle, and then setting the average value is set as a number average primary diameter of the fatty acid metal salt particles.

The ratio (D:A/D:Si) of an average particle diameter of the fatty acid metal salt particles (D:A) to an average particle diameter of the silica particles (D:Si) is preferably from 2.5 to 375.0.

Other External Additives

Examples of other external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$, $MgCO_3$, $BaSO_4$, and $MgSO_4$ in addition to specific silica particles.

Surfaces of the inorganic particles as other external additives are preferably subjected to a hydrophobizing treatment. The hydrophobizing treatment is performed by, for example, dipping the inorganic particles in a hydrophobizing agent. The hydrophobizing agent is not particularly limited; for example, a silane coupling agent, silicone oil, a titanate coupling agent, and an aluminum coupling agent. These may be used singly or in combination of two or more types thereof.

Generally, the amount of the hydrophobizing agent is, for example, preferably from 1 part by weight to 10 parts by weight with respect to 100 parts by weight of inorganic particles.

Examples of other external additives include a resin particle (resin particle such as polystyrene, poly methyl methacrylate (PMMA), and melamine resin), and a cleaning aid (for example, a particle of fluorine high molecular weight material).

External Additive Amount

In order to prevent the abrasion of the photoreceptor, the external additive amount (content) of the specific silica particles is preferably from 0.1% by weight to 6.0% by weight, is further preferably from 0.3% by weight to 4.0% by weight, and is still further preferably from 0.5% by weight to 2.5% by weight, with respect to the toner particles.

In order to prevent the abrasion of the photoreceptor, the additive amount of the fatty acid metal salt particles is preferably from 0.03% by weight to 0.4% by weight, and is further preferably from 0.05% by weight to 0.3% by weight with respect to the toner particles.

The content ratio of the specific silica particles to the fatty acid metal salt particles (specific silica particle/fatty acid metal salt particles) is preferably from 3.5 to 30, is further preferably from 5 to 25, and is still further preferably from 10 to 20, on a weight basis.

The external additive amount of other external additives is, for example, preferably from 0% by weight to 5.0% by weight, and is further preferably from 0.5% by weight to 3.0% by weight with respect to the toner particles.

Method of Preparing Toner

Next, the method of preparing toner according to the exemplary embodiment will be described.

The toner according to the exemplary embodiment is obtained by externally adding the external additives with respect to the toner particles after preparing the toner particles.

The toner particles may be prepared by using a drying method (for example, a kneading and grinding method), and a wetting method (for example, an aggregation and coalescence method, a suspension polymerization method, and a dissolution suspension method). The preparing method of toner particles is not particularly limited to the above-described preparing methods, and well-known preparing method may be used.

Among them, the toner particles may be obtained by using the aggregation and coalescence method.

Specifically, for example, in a case where the toner particles are prepared by using the aggregation and coalescence method, the toner particles are prepared through the steps.

The steps include a step of preparing a resin particle dispersion in which resin particles corresponding to binder resins are dispersed (a resin particle dispersion preparing step), a step of forming aggregated particles by aggregating resin particles (other particles as necessary) in the resin particle dispersion (if necessary, in the dispersion mixed with other particle dispersions), (an aggregated particles forming step), and a step of coalescing aggregated particles by heating an aggregated particle dispersion in which aggregated particles are dispersed so as to form toner particles (a coalescence step).

Hereinafter, the respective steps will be described in detail.

In the following description, a method of obtaining toner particles including a colorant and a release agent will be described. However, the colorant and the release agent are used only if necessary. Other additives other than the colorant and the release agent may also be used.

Resin Particle Dispersion Preparing Step

First, a resin particle dispersion in which resin particles corresponds to binder resins are dispersed, a colorant particle dispersion in which colorant particles are dispersed, and a release agent particle dispersion in which the release agent particles are dispersed are prepared, for example.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more types thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among them, anionic surfactants and cationic surfactants are particularly preferable. Nonionic surfactants may be used in combination with anionic surfactants or cationic surfactants.

The surfactants may be used singly or in combination of two or more types thereof.

Regarding the resin particle dispersion, as a method of dispersing the resin particles in the dispersion medium, a common dispersing method using, for example, a rotary shearing-type homogenizer, or a ball mill, a sand mill, or a Dyno mill as media is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion)

from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, further preferably from 0.08 μm to 0.8 μm, and still further preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersion liquids is also measured in the same manner.

The content of the resin particles contained in the resin particle dispersion is, for example, preferably from 5% by weight to 50% by weight, and further preferably from 10% by weight to 40% by weight.

For example, the colorant particle dispersion and the release agent particle dispersion are also prepared in the same manner as in the case of the resin particle dispersion. That is, the resin particles in the resin particle dispersion are the same as the particles of the colorant dispersed in the colorant dispersion, and the release agent particle dispersed in the release agent particle dispersion, in terms of the volume average particle diameter, the dispersion medium, the dispersing method, and the content of the particles in the resin particle dispersion.

Aggregated Particles Forming Step

Next, the resin particle dispersion, the colorant particle dispersion, and the release agent particle dispersion are mixed with each other.

The resin particles, the colorant particles, and the release agent particle are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, in a range of glass transition temperature of −30° C. to glass transition temperature of −10° C. of the resin particles) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, a divalent or more metal complex. Particularly, when a metal complex is used as the aggregating agent, the amount of the surfactant used is reduced and charging characteristics are improved.

An additive for forming a bond of metal ions as the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably from 0.01 parts by weight to 5.0 parts by weight, and is further preferably equal to or greater than 0.1 parts by weight and less than 3.0 parts by weight, with respect to 100 parts by weight of resin particle.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to perform the coalesce on the aggregated particles and form toner particles.

The toner particles are obtained through the foregoing steps.

Note that, the toner particles may be obtained through a step of forming a second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so as to be attached on the surface of the aggregated particle, and a step of forming the toner particles having a core/shell structure by heating a second aggregated particle dispersion in which the second aggregated particles are dispersed, and coalescing the second aggregated particles.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is manufactured by adding and mixing, for example, an external additive to the obtained dry toner particles, as necessary.

The mixing may be performed with, for example, a V-blender, a Henschel mixer, a Lodige mixer, or the like. Furthermore, if necessary, coarse particles of the toner may be removed by using a vibration sieving machine, a wind classifier, or the like.

Electrostatic Charge Image Developer

An electrostatic charge image developer according to this exemplary embodiment contains at least the toner according to this exemplary embodiment.

The electrostatic charge image developer according to this exemplary embodiment may be a single-component developer containing only the toner according to this exemplary embodiment, or a two-component developer obtained by mixing the toner with a carrier.

The carrier is not particularly limited, and a well-known carrier may be used. Examples of the carrier include a coating carrier in which the surface of the core formed of magnetic powders is coated with the coating resin; a magnetic powder dispersion-type carrier in which the magnetic powders are dispersed and distributed in the matrix resin; and a resin impregnated-type carrier in which a resin is impregnated into the porous magnetic powders.

Note that, the magnetic powder dispersion-type carrier and the resin impregnated-type carrier may be a carrier in which the forming particle of the above carrier is set as a core and the core is coated with the coating resin.

Examples of the magnetic powder include a magnetic metal such as iron, nickel, and cobalt, and a magnetic oxide such as ferrite, and magnetite.

Examples of the coating resin and the matrix resin include a straight silicone resin formed by containing polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and an organosiloxane bond, or the modified products thereof, a fluororesin, polyester, polycarbonate, a phenol resin, and an epoxy resin.

Note that, other additives such as the conductive particles may be contained in the coating resin and the matrix resin.

Examples of the conductive particle include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the toner to the carrier in the two-component developer is preferably in a range of toner:carrier=1:100 to 30:100, and is further preferably in a range of 3:100 to 20:100.

Image Forming Apparatus and Image Forming Method

An image forming apparatus and an image forming method according to this exemplary embodiment will be described.

The image forming apparatus according to the exemplary embodiment is provided with an image holding member, a charging unit that charges the surface of the image holding member, an electrostatic charge image forming unit that forms an electrostatic charge image on the charged surface of the image holding member, a developing unit that accommodates an electrostatic charge image developer, and develops the electrostatic charge image formed on the surface of the image holding member as a toner image by using the electrostatic charge image developer, a transfer unit that transfers the toner image formed on the surface of the image holding member to a surface of a recording medium, a cleaning unit that includes a cleaning blade for cleaning the surface of the image holding member, and a fixing unit that fixes the toner image transferred onto the surface of the recording medium. In addition, the electrostatic charge image developer according to the exemplary embodiment is used as the electrostatic charge image developer.

In the image forming apparatus according to the exemplary embodiment, an image forming method (the image forming method according to the exemplary embodiment) including a step of charging a surface of an image holding member, a step of forming an electrostatic charge image on the charged surface of the image holding member, a step of developing an electrostatic charge image formed on the surface of the image holding member as a toner image by using the electrostatic charge image developer according to the exemplary embodiment, a step of transferring the toner image formed on the surface of the image holding member to a surface of a recording medium, a step of cleaning the surface of the image holding member by using a cleaning blade, and a step of fixing the toner image transferred to the surface of the recording medium is performed.

Examples of the image forming apparatus according to the exemplary embodiment include a well-known image forming apparatus such as a direct transfer-type apparatus that directly transfers a toner image formed on the surface of the image holding member to the recording medium; an intermediate transfer-type apparatus that primarily transfers the toner image formed on the image holding member to the surface of the intermediate transfer member, and secondarily transfers the toner image transferred to the surface of the intermediate transfer member to the recording medium; and an apparatus that is provided with a discharging unit for discharging the surface of the image holding member before being charged by irradiating the surface of the image holding member with discharging light, after transferring the toner image.

In a case of the intermediate transfer-type apparatus, the transfer unit is configured to include an intermediate transfer member in which the toner image is transferred to the surface, a primary transfer unit for primarily transferring the toner image formed on the surface of the image holding member to the surface of the intermediate transfer member, and a secondary transfer unit for secondarily transferring the toner image transferred to the surface of the intermediate transfer member to the surface of the recording medium.

Note that, in the image forming apparatus according to the exemplary embodiment, for example, a portion including the developing unit may have a cartridge structure (a process cartridge), which is detachable from the image forming apparatus. As the process cartridge, for example, a process cartridge which is provided with a developing unit that accommodates the electrostatic charge image developer according to the exemplary embodiment is preferably used.

Hereinafter, an example of the image forming apparatus according to the exemplary embodiment will be described; however, the invention is not limited thereto. Note that, in the drawing, major portions will be described, and others will not be described.

FIG. 1 is a configuration diagram schematically illustrating an example of an image forming apparatus of this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. The support roll 24 is pressurized in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toners including four color toners, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration. Thus, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that includes a cleaning blade 6Y-1, and removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, and thus, an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, and thus, the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer roll, a primary transfer bias is applied to the primary transfer roll 5Y and an electrostatic force toward the primary transfer roll 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA. in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, thereby forming a fixed image.

Examples of the recording sheet P onto which a toner image is transferred include plain paper that is used in electrophotographic copiers, printers, and the like, and as a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge and Toner Cartridge

A process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and as necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
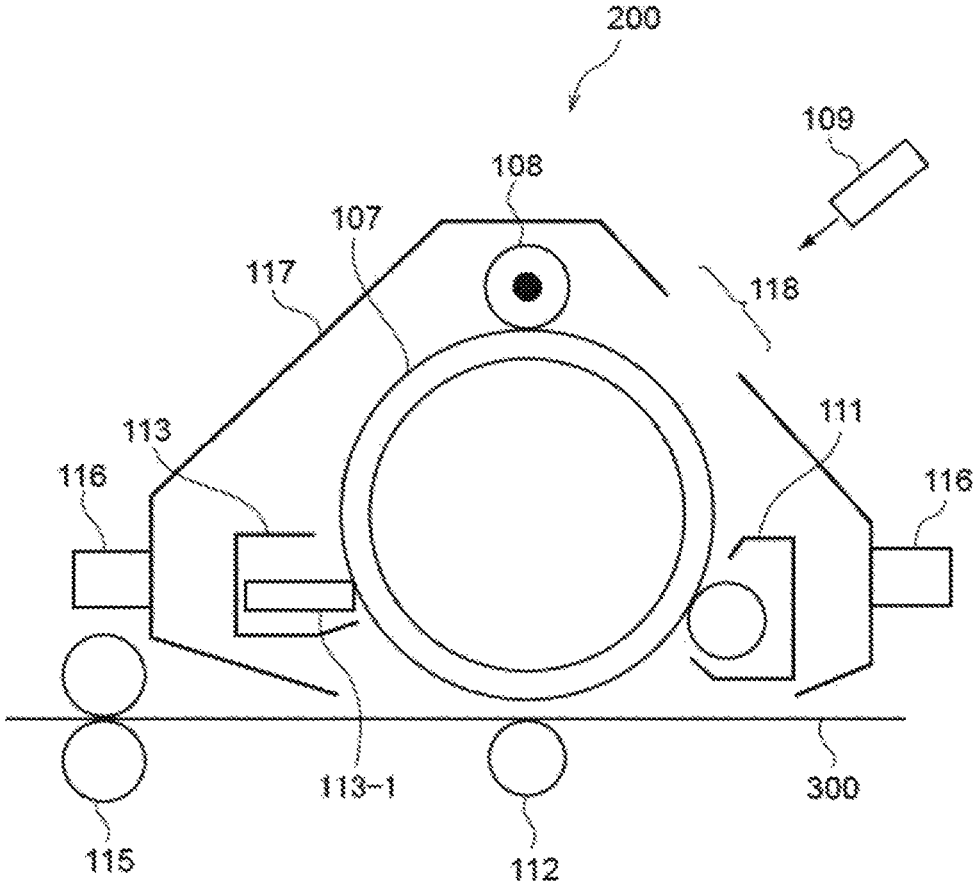
FIG. 2 is a configuration diagram schematically illustrating an example of a process cartridge of this exemplary embodiment.

FIG. 2 is a schematic diagram illustrating a configuration of the process cartridge according to this exemplary embodiment.

The process cartridge 200 illustrated in FIG. 2 is configured such that a photoreceptor 107 (an example of the image holding member), a charging roller 108 (an example of the charging unit) which is provided in the vicinity of the photoreceptor 107, a developing device 111 (an example of the developing unit), and a photoreceptor cleaning device 113 (an example of the cleaning unit) including a cleaning blade 113-1 are integrally formed in combination, and are held by a housing 117 which is provided with an attached rail 116 and an opening portion 118 for exposing light. Note that, in FIG. 2, reference numeral 109 is denoted as an exposing device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, a toner cartridge according to the exemplary embodiment will be described.

The toner cartridge according to the exemplary embodiment accommodates the toner according to the exemplary embodiment and is detachable from an image forming apparatus. The toner cartridge contains a toner for replenishment for being supplied to the developing unit provided in the image forming apparatus. The toner cartridge according to the exemplary embodiment may have a container containing the electrostatic charge image developing toner.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, the exemplary embodiment will be described in detail using examples, but is not limited to these examples. In the following description, unless specifically noted, "parts" and "%" are based on the weight.

Preparation of Toner Particles

Preparation of Toner Particles (1)

Preparation of Polyester Resin Particle Dispersion (1)

- Ethylene glycol (manufactured by Wako Pure Chemical Industries, Ltd.): 37 parts
- Neopentyl glycol (manufactured by Wako Pure Chemical Industries, Ltd.): 65 parts
- 1,9-nonandiol (manufactured by Wako Pure Chemical Industries, Ltd.): 32 parts
- Terephthalic acid (manufactured by Wako Pure Chemical Industries, Ltd.: 96 parts The monomers are put into a flask, heated up to 200° C. for one hour, and 1.2 parts of dibutyl tin oxide is put into the flask after the inside of a reaction system is confirmed to be uniformly stirred. Furthermore, the temperature is elevated over 6 hrs from 200° C. up to 240° C. while distilling away the generated water, a dehydration condensation reaction is further continued for 4 hrs at 240° C., thereby, a polyester resin A having an acid value of 9.4 mg KOH/g, a weight average molecular weight of 13,000 and a glass transition temperature of 62° C. is obtained.

Then, the polyester resin A in a melt state is delivered to CAVITRON CD1010 (trade name, produced by Eurotech Company) at a speed of 100 parts/min. Dilute ammonia water of a concentration of 0.37% which is obtained by diluting reagent ammonia water by ion exchange water is put into a separately prepared aqueous medium tank, and is delivered at a speed of 0.1 L/min to the CAVITRON together with the melted polyester resin while being heated at 120° C. by a heat exchanger. The CAVITRON is operated under the conditions of a speed of rotation of a rotor of 60 Hz and pressure of 5 kg/cm$^2$, and thereby a polyester resin particle dispersion (1), in which resin particles having an average particle diameter of 160 nm, a solid content of 30%, a glass transition temperature of 62° C. and a weight average molecular weight Mw of 13,000 are dispersed, is obtained.

Preparation of Colorant Particle Dispersion

Cyan pigment (Pigment Blue 15: 3, manufactured by Dainichiseika Color & Chemicals Mfg. Co., Ltd.): 10 parts Anionic surfactant (NEOGEN SC, manufactured by Dai-ichi Kogyo Seiyaku Co., Ltd.: 2 parts Ion exchange water: 80 parts The above components are mixed and dispersed for one hour by using a high-pressure impact disperser ULTIMAIZER (HJP30006, manufactured by Sugino Machine Ltd.) and thereby a colorant particle dispersion that has a volume average particle diameter of 180 nm and a solid content of 20% is obtained.

Preparation of Release Agent Particle Dispersion

Carnauba wax (RC-160, melting temperature 84° C., manufactured by Toa Kasei Co., Ltd.) 50 parts Anionic surfactant (NEOGEN SC, produced by Dai-Ichi Kogyo Seiyaku Co., Ltd.): 2 parts Ion exchange water: 200 parts The above components are heated at 120° C., mixed, and dispersed by using ULTRA-TURRAX T50, manufactured by IKA Ltd., followed by dispersing by using a pressure discharge type homogenizer, and thereby a release agent particle dispersion having a volume average particle diameter of 200 nm and a solid content of 20%.

Preparation of Toner Particles (1)

Polyester resin particle dispersion (1): 200 parts

Colorant particle dispersion: 25 parts

Release agent particle dispersion: 30 parts

Polyaluminum chloride: 0.5 parts

Ion exchange water: 100 parts

The above components are put into a stainless steel flask, mixed and dispersed by using ULTRA-TURRAX, manufactured by IKA Ltd., and heated up to 45° C. while stirring the flak by using a heating oil bath. The mixture liquid is kept at 45° C. for 30 min, and then 70 parts of the polyester resin particle dispersion (1) are added thereto.

Thereafter, the pH in the system is adjusted to 8.0 by using an aqueous sodium hydroxide solution having a concentration of 0.5 mol/L, the stainless steel flask is hermetically sealed, a seal of the stirring axis is magnetically sealed, and the system is heated 86° C. and kept in that state for 4 hrs under continued stirring. After the reaction comes to completion, the system is cooled at a temperature-decrease speed of 2° C./min, followed by filtration and washing with ion exchange water, further followed by solid-liquid separation by using a nutche type suction filtration. The obtained product is re-dispersed by using 3 L of ion exchange water having a temperature of 30° C. and the obtained liquid is stirred and washed at 300 rpm for 15 min. The washing operation is further repeated six times and, when the pH of the filtrate becomes 7.54 and the electric conductivity becomes 6.5 μS/cm, solid-liquid separation is conducted with a No. 5A filter paper by a nutche suction filtration. In the next place, vacuum drying is continued for 12 hrs and thereby toner particles (1) are obtained.

The volume average particle diameter D50v of toner particles (1) is 4.7 μm, and the average circularity is 0.964.

Preparation of Toner Particles (2)

Polyester resin particle dispersion (1): 200 parts

Colorant particle dispersion: 25 parts

Release agent particle dispersion: 30 parts

Polyaluminum chloride: 0.4 parts

Ion exchange water: 100 parts

The components are mixed and dispersed by using ULTRA TURRAX, manufactured by IKA Co., Ltd. in the stainless steel flask, and then the flask is heated to 47° C. under stirring in an oil bath for heating and kept at 47° C. for 30 minutes. Thereafter, 70 parts of polyester resin particle dispersion (1) is added thereto.

Thereafter, the pH in the system is adjusted to 8.0 by using an aqueous sodium hydroxide solution having a concentration of 0.5 mol/L, the stainless steel flask is hermetically sealed, a seal of the stirring axis is magnetically sealed, and the system is heated 90° C. and kept in that state for 7 hrs under continued stirring. After the reaction comes to completion, the system is cooled at a temperature-decrease speed of 2° C./min, followed by filtration and washing with ion exchange water, further followed by solid-liquid separation by using a nutche type suction filtration. The obtained product is re-dispersed by using 3 L of ion exchange water having a temperature of 30° C. and the obtained liquid is stirred and washed at 300 rpm for 15 min. The washing operation is further repeated six times and, when the pH of the filtrate becomes 7.54 and the electric conductivity becomes 6.5 μS/cm, solid-liquid separation is conducted with a No. 5A filter paper by a nutche suction filtration. In the next place, vacuum drying is continued for 12 hrs and thereby toner particles (2) are obtained.

The volume average particle diameter D50v of toner particles (2) is 5.7 μm, and the average circularity is 0.982.

Preparation of Toner Particles (3)

Polyester resin particle dispersion (1): 200 parts

Colorant particle dispersion: 25 parts

Release agent particle dispersion: 30 parts

Polyaluminum chloride: 0.4 parts

Ion exchange water: 100 parts

The above components are put into a stainless steel flask, mixed and dispersed by using ULTRA-TURRAX, manufactured by IKA Ltd., and heated up to 48° C. while stirring the flak by using a heating oil bath. The mixture liquid is kept at 48° C. for 30 min, and then 70 parts of the polyester resin particle dispersion (1) are added thereto.

Thereafter, the pH in the system is adjusted to 8.7 by using an aqueous sodium hydroxide solution having a concentration of 0.5 mol/L, the stainless steel flask is hermetically sealed, a seal of the stirring axis is magnetically sealed, and the system is heated 85° C. and kept in that state for 6 hrs under continued stirring. After the reaction comes to completion, the system is cooled at a temperature-decrease speed of 2° C./min, followed by filtration and washing with ion exchange water, further followed by solid-liquid separation by using a nutche type suction filtration. The obtained product is re-dispersed by using 3 L of ion exchange water having a temperature of 30° C. and the obtained liquid is stirred and washed at 300 rpm for 15 min. The washing operation is further repeated six times and, when the pH of the filtrate becomes 7.54 and the electric conductivity becomes 6.5 μS/cm, solid-liquid separation is conducted with a No. 5A filter paper by a nutche suction filtration. In the next place, vacuum drying is continued for 12 hrs and thereby toner particles (3) are obtained.

The volume average particle diameter D50v of toner particles (3) is 5.9 μm, and the average circularity is 0.948.

Preparation of Silica Particle

Preparation of Silica Particle Dispersion (1)

In a glass reaction vessel of 1.5 L which is provided with a stirrer, a dropping nozzle and a thermometer, 300 parts of methanol and 70 parts of 10% ammonia water are added and mixed so as to obtain an alkali catalyst solution.

The alkali catalyst solution is adjusted to 30° C., and then while the alkali catalyst solution is stirred, the dropwise addition of 185 parts of tetramethoxysilane and the dropwise addition of 50 parts of 8.0% ammonia water are concurrently performed so as to obtain a hydrophilic silica particle dispersion (concentration of solid content: 12.0%). Here, the time for the dropwise addition is set to be 30 min.

Thereafter, the obtained silica particle dispersion is concentrated to a concentration of solid content of 40% by using a ROTARY FILTER R-FINE (manufactured by Kotobuki Co. Ltd.). The concentrated material is denoted as a silica particle dispersion (1).

Preparation of Silica Particle Dispersion (2) to (8)

Silica particle dispersions (2) to (8) are prepared by using the same method as that used in the silica particle dispersion (1) except that an alkali catalyst solution (the amount of methanol, and the amount of 10% ammonia water), and conditions for preparing silica particle (total dropwise addition amount of tetramethoxysilane (referred to as TMOS) and 8% ammonia water in the alkali catalyst solution and dropwise addition time) are changed in the preparation of the silica particle dispersion (1), as shown in Table 1.

Hereinafter, the details of the silica particle dispersions (1) to (8) are indicated in Table 1.

TABLE 1

| | Alkali catalyst solution | | Conditions for preparing silica particle | | |
|---|---|---|---|---|---|
| | | | TMOS total | total dropwise addition amount | |
| Silica particle dispersion | Methanol (parts) | 10% ammonia water (parts) | dropwise addition amount (parts) | 8% ammonia water (parts) | Time for dropwise addition |
| (1) | 300 | 70 | 185 | 50 | 30 minutes |
| (2) | 300 | 70 | 340 | 92 | 55 minutes |
| (3) | 300 | 46 | 40 | 25 | 30 minutes |
| (4) | 300 | 70 | 62 | 17 | 10 minutes |
| (5) | 300 | 70 | 700 | 200 | 120 minutes |
| (6) | 300 | 70 | 500 | 140 | 85 minutes |
| (7) | 300 | 70 | 1000 | 280 | 170 minutes |
| (8) | 300 | 70 | 3000 | 800 | 520 minutes |

Preparation of Surface Treatment Silica Particle (S1)

As described below, with the silica particle dispersion (1), a surface treatment is performed with respect to the silica particle by a siloxane compound under the atmosphere of supercritical carbon dioxide. Note that, the surface treatment is performed by using an apparatus which is provided with a carbon dioxide cylinder, a carbon dioxide pump, an entrainer pump, an autoclave equipped with a stirrer (capacitance: 500 ml), and a pressure valve.

First, 250 parts of the silica particle dispersion (1) is put into the autoclave equipped with a stirrer (capacitance: 500 ml), and the stirrer is rotated at 100 rpm. Then, the autoclave is filled with liquefied carbon dioxide. The temperature in the autoclave is increased to 150° C. by a heater, and then a pressure is applied to 15 MPa by the carbon dioxide pump for a supercritical state. While the pressure in the autoclave is maintained at 15 MPa by the pressure valve, supercritical carbon dioxide is circulated by the carbon dioxide pump to remove methanol and water from the silica particle dispersion (1) (solvent removing step), thereby obtaining silica particles (untreated silica particles).

Next, at the time point when the circulation amount of the circulated supercritical carbon dioxide (integrated amount: measured as a circulation amount of carbon dioxide in a standard state) is 900 parts, the circulation of the supercritical carbon dioxide is stopped.

Thereafter, while the temperature is maintained at 150° C. by a heater, and the pressure is maintained at 15 MPa by a carbon dioxide pump, in a state in which the supercritical carbon dioxide in the autoclave is maintained, a treatment agent solution in which 0.3 parts of dimethyl silicone oil (DSO: product name, "KF-96 (manufactured by Shin-Etsu Chemical Co., Ltd.)") having a viscosity of 10,000 cSt, as a siloxane compound, is dissolved in 20 parts of hexamethyldisilazane (HMDS: manufactured by Yuki Gosei Kogyo Co., Ltd., Inc.) with respect to the above-described 100 parts of silica particles (untreated silica particles) in advance, is added into the autoclave by the entrainer pump as a hydrophobizing agent stirred, and reacted at 180° C. for 20 minutes. Subsequently, the supercritical carbon dioxide is circulated again so as to remove the excessive treatment agent solution. Then, the stirring is stopped, the pressure valve is opened, and the pressure in the autoclave is opened to atmospheric pressure to cool the mixture to room temperature (25° C.).

In this manner, the solvent removing step and the surface treatment using a siloxane compound are sequentially performed to obtain silica particles (S1).

Preparation of Surface Treatment Silica Particles (S2) to (S5), (S7) to (S9), and (S12) to (S17)

Surface treatment silica particles (S2) to (S5), (S7) to (S9), and (S12) to (S17) are prepared by using the same method of that used in the surface treatment silica particles (S1) except that the silica particle dispersion, conditions for surface treatment (treatment atmosphere, siloxane compound (types, the viscosity and the additive amount thereof), and a hydrophobizing agent and the additive amount thereof) are changed in the surface treatment silica particle (S1), as shown in Table 2.

Preparation of Surface Treatment Silica Particle (S6)

As described below, with the silica particle dispersion (1) which is used to prepare the surface treatment silica particle (S1), a surface treatment is performed with respect to the silica particle by a siloxane compound under the atmosphere.

An ester adapter and a cooling pipe are mounted on the reaction vessel used to prepare the silica particle dispersion (1), then when the silica particle dispersion (1) is heated at a temperature in a range of 60° C. to 70° C. so as to distill methanol, water is added thereto, and then further heated at a temperature in a range of 70° C. to 90° C. so as to distill methanol, thereby obtaining an aqueous dispersion of the silica particle. 3 parts of methyl trimethoxysilane (MTMS: manufactured by Shin-Etsu Chemical Co., Ltd.) is added with respect to 100 parts of silica solid content in the aqueous dispersion at room temperature (20° C.) and reacted for two hours so as to perform the treatment of silica particle surface. Methyl isobutyl ketone is added into the obtained surface treatment dispersion, and then heated at a temperature in a range of 80° C. to 110° C. so as to distill methanol water. 80 parts of hexamethyldisilazane (HMDS: manufactured by Yuki Gosei Kogyo Co., Ltd., Inc.), and 1.0 parts of dimethyl silicone oil (DSO: product name, "KF-96 (manufactured by Shin-Etsu Chemical Co., Ltd.)") having a viscosity of 10,000 cSt as a siloxane compound are added with respect to 100 parts of silica solid content in the obtained dispersion at room. temperature (20° C.), reacted at 120° C. for 3 hrs, cooled, and dried by spray drying, thereby obtaining surface treatment silica particles (S6).

Preparation of Surface Treatment Silica Particles (S10)

Surface treatment silica particles (S10) are prepared by using the same method of that used in the surface treatment silica particles (S1) except that FUMED SILICA OX50 (AEROSIL OX50, manufactured by Nippon Aerosil Co., Ltd.) is used instead of the silica particle dispersion (1). That is, similar to the case of the preparation of the surface treatment silica particles (S1), 100 parts of OX50 is put into the autoclave equipped with a stirrer, and the stirrer is rotated at 100 rpm. Then, the autoclave is filled with liquefied carbon dioxide. The temperature in the autoclave is increased to 180° C. by a heater, and then a pressure is applied to 15 MPa by the carbon dioxide pump for a supercritical state. While the pressure in the autoclave is maintained at 15 MPa by the pressure valve, a treatment agent solution in which 0.3 parts of dimethyl silicone oil (DSO: product name, "KF-96 (manufactured by Shin-Etsu Chemical Co., Ltd.)") having a viscosity of 10,000 cSt, as a siloxane compound, is dissolved in 20 parts of hexamethyldisilazane (HMDS: manufactured by Yuki Gosei Kogyo Co., Ltd., Inc.) in advance, is added into the autoclave by the entrainer pump as a hydrophobizing agent, stirred, and reacted at 180° C. for 20 minutes. Subsequently, the supercritical carbon dioxide is circulated again so as to remove the excessive treatment agent solution, thereby obtaining surface treatment silica particles (S10).

Preparation of Surface Treatment Silica Particles (S11)

Surface treatment silica particles (S11) are prepared by using the same method of that used in the surface treatment silica particles (S1) except that FUMED SILICA A50 (AEROSIL A50, manufactured by Nippon Aerosil Co., Ltd.) is used instead of the silica particle dispersion (1). That is, similar to the case of the preparation of the surface treatment silica particles (S1), 100 parts of A50 is put into the autoclave equipped with a stirrer, and the stirrer is rotated at 100 rpm. Then, the autoclave is filled with liquefied carbon dioxide. The temperature in the autoclave is increased to 180° C. by a heater, and then a pressure is applied to 15 MPa by the carbon dioxide pump for a supercritical state. While the pressure in the autoclave is maintained at 15 MPa by the pressure valve, a treatment agent solution in which 1.0 parts of dimethyl silicone oil (DSO: product name, "KF-96 (manufactured by Shin-Etsu Chemical Co., Ltd.)") having a viscosity of 10,000 cSt, as a siloxane compound, is dissolved in 40 parts of hexamethyldisilazane (HMDS: manufactured by Yuki Gosei Kogyo Co., Ltd., Inc.) in advance, is added into the autoclave by the entrainer pump as a hydrophobizing agent, stirred, and reacted at 180° C. for 20 minutes. Subsequently, the supercritical carbon dioxide is circulated again so as to remove the excessive treatment agent solution, thereby obtaining surface treatment silica particles (S11).

Preparation of Surface Treatment Silica Particles (SC1)

Surface treatment silica particles (SC1) are prepared by using the same method as that used in the surface treatment silica particle (S1) except that a siloxane compound is not added in the preparation of the surface treatment silica particle (S1).

Preparation of Surface Treatment Silica Particles (SC2) to (SC4)

Surface treatment silica particles (SC2) to (SC4) are prepared by using the same method of that used in the surface treatment silica particles (S1) except that the silica particle dispersion, conditions for surface treatment (treatment atmosphere, siloxane compound (types, the viscosity and the additive amount thereof), and a hydrophobizing agent and the additive amount thereof) are changed in the surface treatment silica particle (S1), as shown in Table 3.

Preparation of Surface Treatment Silica Particles (SC5)

Surface treatment silica particles (SC5) are prepared by using the same method as that used in the surface treatment silica particle (S6) except that a siloxane compound is not added in the preparation of the surface treatment silica particle (S6).

Preparation of Surface Treatment Silica Particles (SC6)

The silica particle dispersion (8) is filtrated, dried at 120° C., and put into an electric furnace so as to be baked at 400° C. for 6 hrs, and thereafter, 10 parts of HMDS is sprayed and dried with respect to 100 parts of the silica particles by using a spray drying method, thereby preparing surface treatment silica particles (SC6).

Physical Properties of Surface Treatment Silica Particle

Regarding the obtained surface treatment silica particles, the average equivalent circle diameter, the average circularity, the attachment amount (denoted as "surface attachment amount" in Table) of the siloxane compound with respect to the untreated silica particles, the compression aggregation degree, the particle compression ratio, and the particle dispersion degree are measured by using the above-described methods.

Hereinafter, the details of the surface treatment silica particles are indicated in the lists in Table 2 to Table 5. Note that, the abbreviations in Table 2 and Table 3 are as follows:

DSO: dimethyl silicone oil

HMDS: hexamethyldisilazane

TABLE 2

| | | Conditions for surface treatment | | | | |
|---|---|---|---|---|---|---|
| | | Siloxane compound | | | | |
| Surface treatment silica particle | Silica particle dispersion | Type | Viscosity (cSt) | Additive amount (parts) | Treatment atmosphere | Hydrophobizing agent/ number of parts |
| (S1) | (1) | DSO | 10000 | 0.3 parts | Supercritical $CO_2$ | HMDS/20 parts |
| (S2) | (1) | DSO | 10000 | 1.0 part | Supercritical $CO_2$ | HMDS/20 parts |
| (S3) | (1) | DSO | 5000 | 0.15 parts | Supercritical $CO_2$ | HMDS/20 parts |
| (S4) | (1) | DSO | 5000 | 0.5 parts | Supercritical $CO_2$ | HMDS/20 parts |

TABLE 2-continued

| | | Conditions for surface treatment | | | | |
|---|---|---|---|---|---|---|
| | | Siloxane compound | | | | |
| Surface treatment silica particle | Silica particle dispersion | Type | Viscosity (cSt) | Additive amount (parts) | Treatment atmosphere | Hydrophobizing agent/ number of parts |
| (S5) | (2) | DSO | 10000 | 0.2 parts | Supercritical $CO_2$ | HMDS/20 parts |
| (S6) | (1) | DSO | 10000 | 1.0 part | Atmosphere | HMDS/80 parts |
| (S7) | (3) | DSO | 10000 | 0.3 parts | Supercritical $CO_2$ | HMDS/20 parts |
| (S8) | (4) | DSO | 10000 | 0.3 parts | Supercritical $CO_2$ | HMDS/20 parts |
| (S9) | (1) | DSO | 50000 | 1.5 parts | Supercritical $CO_2$ | HMDS/20 parts |
| (S10) | FUMED SILICA OX50 | DSO | 10000 | 0.3 parts | Supercritical $CO_2$ | HMDS/20 parts |
| (S11) | FUMED SILICA A50 | DSO | 10000 | 1.0 part | Supercritical $CO_2$ | HMDS/40 parts |
| (S12) | (3) | DSO | 5000 | 0.04 parts | Supercritical $CO_2$ | HMDS/20 parts |
| (S13) | (3) | DSO | 1000 | 0.5 parts | Supercritical $CO_2$ | HMDS/20 parts |
| (S14) | (3) | DSO | 10000 | 5.0 parts | Supercritical $CO_2$ | HMDS/20 parts |
| (S15) | (5) | DSO | 10000 | 0.5 parts | Supercritical $CO_2$ | HMDS/20 parts |
| (S16) | (6) | DSO | 10000 | 0.5 parts | Supercritical $CO_2$ | HMDS/20 parts |
| (S17) | (7) | DSO | 10000 | 0.5 parts | Supercritical $CO_2$ | HMDS/20 parts |

TABLE 3

| | | Conditions for surface treatment | | | | |
|---|---|---|---|---|---|---|
| | | Siloxane compound | | | | |
| Surface treatment silica particle | Silica particle dispersion | Type | Viscosity (cSt) | Additive amount (parts) | Treatment atmosphere | Hydrophobizing agent/ number of parts |
| (SC1) | (1) | — | — | — | Supercritical $CO_2$ | HMDS/20 parts |
| (SC2) | (1) | DSO | 100 | 3.0 parts | Supercritical $CO_2$ | HMDS/20 parts |
| (SC3) | (1) | DSO | 1000 | 8.0 parts | Supercritical $CO_2$ | HMDS/20 parts |
| (SC4) | (3) | DSO | 3000 | 10.0 parts | Supercritical $CO_2$ | HMDS/20 parts |
| (SC5) | (1) | — | — | — | Atmosphere | HMDS/80 parts |
| (SC6) | (8) | — | — | — | Atmosphere | HMDS/10 parts |

TABLE 4

| | | Properties of surface treatment silica particle | | | | | |
|---|---|---|---|---|---|---|---|
| Surface treatment silica particle | Silica particle dispersion | Average equivalent circle diameter (nm) | Average circularity | Surface attachment amount (weight %) | Degree of compression and aggregation (%) | Particle compression ratio | Particle dispersion degree (%) |
| (S1) | (1) | 120 | 0.958 | 0.28 | 85 | 0.310 | 98 |
| (S2) | (1) | 120 | 0.958 | 0.98 | 92 | 0.280 | 97 |
| (S3) | (1) | 120 | 0.958 | 0.12 | 80 | 0.320 | 99 |
| (S4) | (1) | 120 | 0.958 | 0.47 | 88 | 0.295 | 98 |
| (S5) | (2) | 140 | 0.962 | 0.19 | 81 | 0.360 | 99 |
| (S6) | (1) | 120 | 0.958 | 0.50 | 83 | 0.380 | 93 |
| (S7) | (3) | 130 | 0.850 | 0.29 | 68 | 0.350 | 92 |
| (S8) | (4) | 90 | 0.935 | 0.29 | 94 | 0.390 | 95 |
| (S9) | (1) | 120 | 0.958 | 1.25 | 95 | 0.240 | 91 |
| (S10) | FUMED SILICA OX50 | 80 | 0.680 | 0.26 | 84 | 0.395 | 92 |
| (S11) | FUMED SILICA A50 | 45 | 0.880 | 0.91 | 88 | 0.276 | 91 |
| (S12) | (3) | 130 | 0.850 | 0.02 | 62 | 0.360 | 96 |
| (S13) | (3) | 130 | 0.850 | 0.46 | 90 | 0.380 | 92 |
| (S14) | (3) | 130 | 0.850 | 4.70 | 95 | 0.360 | 91 |
| (S15) | (5) | 185 | 0.971 | 0.43 | 61 | 0.209 | 96 |
| (S16) | (6) | 164 | 0.97 | 0.41 | 64 | 0.224 | 97 |
| (S17) | (7) | 210 | 0.978 | 0.44 | 60 | 0.205 | 98 |

TABLE 5

| Surface treatment silica particle | Silica particle dispersion | Properties of surface treatment silica particle | | | | | |
|---|---|---|---|---|---|---|---|
| | | Average equivalent circle diameter (nm) | Average circularity | Surface attachment amount (weight %) | Degree of compression and aggregation (%) | Particle compression ratio | Particle dispersion degree (%) |
| (SC1) | (1) | 120 | 0.958 | — | 55 | 0.415 | 99 |
| (SC2) | (1) | 120 | 0.958 | 2.5 | 98 | 0.450 | 75 |
| (SC3) | (1) | 120 | 0.958 | 7.0 | 99 | 0.360 | 83 |
| (SC4) | (3) | 130 | 0.850 | 8.5 | 99 | 0.380 | 85 |
| (SC5) | (1) | 120 | 0.958 | — | 62 | 0.425 | 98 |
| (SC6) | (8) | 300 | 0.980 | — | 60 | 0.197 | 93 |

Preparation of Fatty Acid Metal Salt Particles 4 parts of ion exchange water is put in a heatable stainless reactor 1 which is provided with a stirrer and a temperature sensor, and is heated up to 70° C. while being stirred. 1.4 parts of stearic acids are put in a heatable stainless reactor 2 which is provided with a stirrer and a temperature sensor, and are melted. The melted stearic acid is added to the stainless reactor 1, and the temperature is increased up to 70° C. again while being stirred. Here, an aqueous solution in which 2 parts of sodium hydroxide is melted in 100 parts of ion exchange water is added dropwise to emulsify and disperse fatty acids. 100 parts of zinc hydroxide and 100 parts of zinc sulfate which are melted and dispersed in 3,000 parts of ion exchange water in advance are added dropwise to the emulsified dispersion of fatty acids which is kept at 70° C. After being added dropwise, the temperature is increased up to 80° C., and the emulsified dispersion of fatty acids is reacted at for 60 minutes. Thereafter, water washing, filtration, dewatering, and drying are performed so as to obtain zinc stearate solid. The zinc stearate particles are obtained by grinding the zinc stearate solid with a ball mill. The ball diameter, the filling rate, and the grinding time are adjusted to obtain fatty acid metal salt particles (1) having the average particle diameter of 5 μm, fatty acid metal salt particles (2) having the average particle diameter of 2 μm, fatty acid metal salt particles (3) having the average particle diameter of 0.5 μm, and fatty acid metal salt particles (4) having the average particle diameter of 15 μm.

The fatty acid metal salt particles (5) having the average particle diameter of 2 μm are obtained by replacing stearic acid with lauric acid.

Similarly, fatty acid metal salt particles (6) having the average particle diameter of 2 μm are obtained by replacing zinc hydroxide with calcium hydroxide, and replacing zinc sulfate with calcium sulfate.

Examples 1 to 32, Comparative Examples 1 to 7

The silica particles and the fatty acid metal salt particles which are indicated in Table 6 to Table 9 are added to 100 parts of toner particles indicated in Table 6 to Table 9, by the number of parts illustrated in Table 6 to Table 9, and are mixed at 2,000 rpm for 3 minutes by using a henschel mixer, so as to obtain the toners in the respective examples.

In addition, the obtained toners and carriers are put in the V-blender at the ratio of toner:carrier=5:95 (weight ratio), and stirred for 20 minutes so as to obtain the developers in the respective examples.

Note that, the carrier to be used is prepared as follows.

Ferrite particle (volume average particle diameter: 50 μm) 100 parts

Toluene 14 parts

Styrene-methyl methacrylate copolymer 2 parts (component ratio: 90/10, Mw=80,000)

Carbon black (R330: manufactured by Cabot Corporation.) 0.2 parts

First, the above-described components except for ferrite particle are stirred by a stirrer for 10 minutes and dispersed so as to prepare a coating liquid. Then, the coating liquid and the ferrite particle are put in a vacuum degassing kneader, stirred at 60° C. for 30 minutes, compressed while being heated, degassed, and dried, and thereby a carrier is obtained.

Evaluation

Regarding the developers obtained in the respective examples, the formed toner images are evaluated. The results are indicated in Table 6 to Table 9.

Evaluation of Image Defects

A developing unit of the image forming apparatus "DOCUCENTRE COLOR 400 manufactured by Fuji Xerox Co., Ltd." is filled with the developers obtained in the respective examples. 50,000 gradation charts having an image density of 20% are manufactured by using the image forming apparatus under the environment of the temperature of 30° C. and humidity of 80% RH. The gradation chart is provided with a solid portion, a half-tone portion, and a background portion. The evaluation is performed for the quality of image for each 10,000 copies at the time of printing 50,000 copies. Note that, at an initial stage, the first image is evaluated. The image quality is visually evaluated in terms of graininess, tonality, pseudo-contour, concentration of reproducibility, other image quality defects and color streaks. Evaluation index is as follows.

A: level at which image quality defects are almost not observed even with X25 times of magnifier B: level at which image quality defects are not visually clear C: level at which practical problems are not visually found D: level at which image quality defects are visually recognized, and are unacceptable Abrasion Loss of Photoreceptor The film thickness of the outermost surface layer of the photoreceptor at an initial stage is measured in advance before forming an image, and the difference between the obtained film thickness and the film thickness of the outermost surface layer of the photoreceptor after preparing 50,000 gradation charts having an image density of 20% is obtained under the environment of temperature of 30° C. and humidity of 80% RH so as to calculate the abrasion loss (μm) of the surface protective layer. Note that, PERMASCOPE manufactured by Fischer Instrument Co., Ltd. is used as a film thickness gauge.

TABLE 6

| | Developer | | | | | | | | | | | Abrasion |
|---|---|---|---|---|---|---|---|---|---|---|---|---|
| | | Surface treatment | | Fatty acid | | Evaluation of toner image | | | | | | loss (μm) |
| | | silica particle | | metal salt | | | After | After | After | After | After | After |
| | Toner particle | Type | Number of parts | Type | Number of parts | Initial stage | 10,000 copies | 20,000 copies | 30,000 copies | 40,000 copies | 50,000 copies | 50,000 copies |
| Example 1 | (2) | (S1) | 2 | (1) | 0.1 | A | A | A | A | A | A | 0.8 |
| Example 2 | (2) | (S2) | 2 | (1) | 0.1 | A | A | A | A | A | A | 0.9 |
| Example 3 | (2) | (S3) | 2 | (1) | 0.1 | A | A | A | A | A | A | 0.8 |
| Example 4 | (2) | (S4) | 2 | (1) | 0.1 | A | A | A | A | A | A | 0.9 |
| Example 5 | (2) | (S5) | 2 | (1) | 0.1 | A | A | A | A | A | A | 0.8 |
| Example 6 | (2) | (S6) | 2 | (1) | 0.1 | A | A | A | A | B | B | 1.3 |
| Example 7 | (2) | (S7) | 2 | (1) | 0.1 | A | A | B | B | B | B | 1.6 |
| Example 8 | (2) | (S8) | 2 | (1) | 0.1 | A | A | A | B | B | B | 1.7 |
| Example 9 | (2) | (S9) | 2 | (1) | 0.1 | A | A | B | B | B | B | 1.8 |
| Example 10 | (2) | (S10) | 2 | (1) | 0.1 | A | B | B | C | C | C | 2.7 |

TABLE 7

| | Developer | | | | | | | | | | | Abrasion |
|---|---|---|---|---|---|---|---|---|---|---|---|---|
| | | Surface treatment | | Fatty acid | | Evaluation of toner image | | | | | | loss (μm) |
| | | silica particle | | metal salt | | | After | After | After | After | After | After |
| | Toner particle | Type | Number of parts | Type | Number of parts | Initial stage | 10,000 copies | 20,000 copies | 30,000 copies | 40,000 copies | 50,000 copies | 50,000 copies |
| Example 11 | (2) | (S11) | 2 | (1) | 0.1 | A | B | B | C | C | C | 2.7 |
| Example 12 | (2) | (S12) | 2 | (1) | 0.1 | A | B | B | C | C | C | 2.8 |
| Example 13 | (2) | (S13) | 2 | (1) | 0.1 | A | A | B | B | B | B | 1.7 |
| Example 14 | (2) | (S14) | 2 | (1) | 0.1 | A | A | A | A | A | A | 0.9 |
| Example 15 | (2) | (S15) | 2 | (1) | 0.1 | A | B | C | C | C | C | 2.7 |
| Example 16 | (2) | (S16) | 2 | (1) | 0.1 | A | B | C | C | C | C | 2.5 |
| Example 17 | (2) | (S17) | 2 | (1) | 0.1 | A | B | C | C | C | C | 2.8 |
| Example 18 | (1) | (S1) | 2 | (1) | 0.1 | A | A | A | A | A | B | 1.1 |
| Example 19 | (3) | (S1) | 2 | (1) | 0.1 | A | A | A | A | B | B | 1.3 |
| Example 20 | (2) | (S1) | 0.1 | (1) | 0.1 | A | A | A | A | B | B | 1.5 |

TABLE 8

| | Developer | | | | | | | | | | | Abrasion |
|---|---|---|---|---|---|---|---|---|---|---|---|---|
| | | Surface treatment | | Fatty acid | | Evaluation of toner image | | | | | | loss (μm) |
| | | silica particle | | metal salt | | | After | After | After | After | After | After |
| | Toner particle | Type | Number of parts | Type | Number of parts | Initial stage | 10,000 copies | 20,000 copies | 30,000 copies | 40,000 copies | 50,000 copies | 50,000 copies |
| Example 21 | (2) | (S1) | 0.5 | (1) | 0.1 | A | A | A | A | A | B | 1.2 |
| Example 22 | (2) | (S1) | 4 | (1) | 0.1 | A | A | A | A | A | B | 1.2 |
| Example 23 | (2) | (S1) | 6 | (1) | 0.1 | A | A | A | A | B | B | 1.4 |
| Example 24 | (2) | (S1) | 2 | (1) | 0.02 | A | B | B | B | B | C | 2.3 |
| Example 25 | (2) | (S1) | 2 | (1) | 0.04 | A | A | A | B | B | B | 1.6 |
| Example 26 | (2) | (S1) | 2 | (1) | 0.32 | A | A | A | B | B | B | 2.5 |
| Example 27 | (2) | (S1) | 2 | (1) | 0.41 | A | B | B | B | B | C | 2.4 |
| Example 28 | (2) | (S1) | 2 | (2) | 0.1 | A | A | A | A | A | A | 0.8 |
| Example 29 | (2) | (S1) | 2 | (3) | 0.1 | A | B | B | B | B | C | 2.2 |
| Example 30 | (2) | (S1) | 2 | (4) | 0.1 | A | B | B | B | B | C | 2.4 |
| Example 31 | (2) | (S1) | 2 | (5) | 0.1 | A | B | B | B | B | C | 2.5 |
| Example 32 | (2) | (S1) | 2 | (6) | 0.1 | A | B | B | B | B | C | 2.4 |

TABLE 9

| | Developer | | | | | | | | | | | Abrasion |
|---|---|---|---|---|---|---|---|---|---|---|---|---|
| | | Surface treatment | | Fatty acid | | Evaluation of toner image | | | | | | loss (μm) |
| | | silica particle | | metal salt | | | After | After | After | After | After | After |
| | Toner particle | Type | Number of parts | Type | Number of parts | Initial stage | 10,000 copies | 20,000 copies | 30,000 copies | 40,000 copies | 50,000 copies | 50,000 copies |
| Comparative Example 1 | (2) | (SC1) | 2 | (1) | 0.1 | C | C | C | D | D | D | 3.6 |
| Comparative Example 2 | (2) | (SC2) | 2 | (1) | 0.1 | C | C | D | D | D | D | 3.4 |
| Comparative Example 3 | (2) | (SC3) | 2 | (1) | 0.1 | C | D | D | D | D | D | 3.6 |
| Comparative Example 4 | (2) | (SC4) | 2 | (1) | 0.1 | C | C | C | D | D | D | 3.4 |
| Comparative Example 5 | (2) | (SC5) | 2 | (1) | 0.1 | C | C | D | D | D | D | 3.7 |
| Comparative Example 6 | (2) | (SC6) | 2 | (1) | 0.1 | C | C | D | D | D | D | 3.7 |
| Comparative Example 7 | (2) | (S1) | 2 | — | — | C | D | D | D | D | D | 3.7 |

From the above-described results, it is found that the abrasion of the photoreceptor is more prevented in the examples than in the comparative examples.

Particularly, it is found that the abrasion of the photoreceptor is more prevented in Examples 1 to 5, 14 in which the silica particles having the compression aggregation degree is from 70% to 95%, and the particle compression ratio is from 0.28 to 0.36 are employed as the external additive, as compared with Examples 6 to 13, and 15 to 17.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and an external additive that includes silica particles having a compression aggregation degree of 60% to 95% and a particle compression ratio of 0.20 to 0.40 and fatty acid metal salt particles, wherein:

a surface attachment amount of the silica particles is from 0.12 wt % to 4.50 wt %, and the silica particles are surface-treated in a supercritical carbon dioxide treatment atmosphere.

2. The electrostatic charge image developing toner according to claim 1, wherein an average equivalent circle diameter of the silica particles is from 40 nm to 200 nm.

3. The electrostatic charge image developing toner according to claim 1, wherein a particle dispersion degree of the silica particles is from 90% to 100%.

4. The electrostatic charge image developing toner according to claim 1, wherein an average circularity of the silica particles is from 0.85 to 0.98.

5. The electrostatic charge image developing toner according to claim 1, wherein the silica particles are sol-gel silica particles.

6. The electrostatic charge image developing toner according to claim 1, wherein an average circularity of the toner particles is from 0.95 to 1.00.

7. The electrostatic charge image developing toner according to claim 1, wherein the silica particles are silica particles that are subjected to a surface treatment with a siloxane compound having a viscosity of 1,000 cSt to 50,000 cSt, and a surface attachment amount of the siloxane compound is from 0.01% by weight to 5% by weight.

8. The electrostatic charge image developing toner according to claim 7, wherein the siloxane compound is a silicone oil.

9. The electrostatic charge image developing toner according to claim 1, wherein the fatty acid metal salt particles contain zinc stearate.

10. The electrostatic charge image developing toner according to claim 1, wherein an average particle diameter of the fatty acid metal salt particles is from 0.5 μm to 15.0 μm.

11. The electrostatic charge image developing toner according to claim 1, wherein the ratio (D:A/D:Si) of an average particle diameter of the fatty acid metal salt particles (D:A) to an average particle diameter of the silica particles (D:Si) is from 2.5 to 375.0.

12. An electrostatic charge image developer comprising the electrostatic charge image developing toner according to claim 1.

13. A toner cartridge comprising:

a container containing the electrostatic charge image developing toner according to claim 1, wherein the toner cartridge is detachable from an image forming apparatus.

14. The electrostatic charge image developing toner according to claim 1, wherein the average circularity of the silica particles is from 0.93 to 0.98.

15. The electrostatic charge image developing toner according to claim 1, wherein the toner particles are comprised of a polyester resin comprising ethylene glycol, neopentyl glycol, 1,9-nonandiol and terephthalic acid.

* * * * *